US006709302B2

(12) United States Patent
Yanagihara

(10) Patent No.: US 6,709,302 B2
(45) Date of Patent: Mar. 23, 2004

(54) ENGINE CONTROL FOR WATERCRAFT

(75) Inventor: Tsuide Yanagihara, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/080,371

(22) Filed: Feb. 15, 2002

(65) Prior Publication Data

US 2003/0013354 A1 Jan. 16, 2003

(30) Foreign Application Priority Data

Feb. 15, 2001 (JP) ..... 2001-038202
Jan. 23, 2002 (JP) ..... 2002-013828

(51) Int. Cl.[7] ..... B63H 21/21
(52) U.S. Cl. ..... 440/1; 440/84; 440/87
(58) Field of Search ..... 440/1, 84, 87; 123/377

(56) References Cited

U.S. PATENT DOCUMENTS

| | | | |
|---|---|---|---|
| 1,843,272 | A | 2/1932 | Evinrude |
| 2,117,016 | A | 5/1938 | Brumbaugh |
| 2,332,697 | A | 10/1943 | Claytor |
| 2,627,836 | A | 2/1953 | Buske |
| 2,682,248 | A | 6/1954 | Sitz |
| 2,977,944 | A | 4/1961 | Holley, Jr. |
| 3,002,487 | A | 10/1961 | Didsbury |
| 3,135,234 | A | 6/1964 | Turnidge |
| 3,183,879 | A | 5/1965 | Heidner |
| 3,343,423 | A | 9/1967 | Thorner |
| 3,348,626 | A | 10/1967 | Thorner |
| 3,489,239 | A | 1/1970 | Thorner |
| 3,777,841 | A | 12/1973 | Torner |
| 3,795,105 | A | 3/1974 | Aschauer |
| 3,874,321 | A | 4/1975 | Smith |
| 3,918,256 | A | 11/1975 | Ashleman |
| 3,971,356 | A | 7/1976 | Schlage |
| 3,976,026 | A | 8/1976 | Eastling |
| 4,008,781 | A | 2/1977 | Ochiai |
| 4,022,179 | A | 5/1977 | Kalert et al. |
| 4,031,844 | A | 6/1977 | Onal et al. |
| 4,100,877 | A | 7/1978 | Scott et al. |
| 4,230,646 | A | 10/1980 | Ghizzoni |
| 4,270,307 | A | 6/1981 | Arigaya |
| 4,305,353 | A | 12/1981 | Robinson et al. |

(List continued on next page.)

FOREIGN PATENT DOCUMENTS

| | | |
|---|---|---|
| CA | 2207938 | 6/1997 |
| CA | 2271332 | 5/1999 |
| JP | 10-103301 | 4/1998 |

OTHER PUBLICATIONS

Co–pending patent application Ser. No. 09/688,534 filed Oct. 16, 2000 in the name of Kanno, entitled Idle Speed Control Value Control System.

Co–pending patent application Ser. No. 09/813,465 filed Mar. 19, 2001 in the name of Iida et al, entitled Engine Output Control for Watercraft.

Co–pending patent application Ser. No. 09/976,820 filed Oct. 11, 2001 in the name of Watanabe, entitled Air Induction System for Multi–Cylinder Engine.

Co–pending patent application Ser. No. 10/085,012 filed Feb. 26, 2002 in the name of Hattori, entitled Engine Control for Watercraft.

*Primary Examiner*—Sherman Basinger
(74) *Attorney, Agent, or Firm*—Knobbe, Martens, Olson & Bear, LLP

(57) ABSTRACT

A watercraft includes an improved engine control system that enhances the responsiveness of the watercraft and eases watercraft operation. The watercraft includes a propulsion device, such as a jet propulsion unit, and an engine that powers the propulsion device. The engine control system is configured to maintain or increase engine speed under certain operating conditions.

16 Claims, 11 Drawing Sheets

U.S. PATENT DOCUMENTS 4,455,978 A 6/1984 Atago et al.
4,462,357 A 7/1984 Lockhart
4,519,335 A 5/1985 Krautkremer et al.
4,566,415 A 1/1986 Iwai et al.
4,693,689 A 9/1987 Harada
4,716,871 A 1/1988 Sakamoto et al.
4,739,236 A 4/1988 Burkenpas
4,747,359 A 5/1988 Ueno
4,759,731 A 7/1988 Uchida et al.
4,759,732 A 7/1988 Atsumi
4,767,363 A 8/1988 Uchida et al.
4,778,414 A 10/1988 Taguchi
4,836,809 A 6/1989 Pelligrino
4,838,113 A 6/1989 Matsushima et al.
4,854,902 A 8/1989 Havins
4,938,721 A 7/1990 Koike
4,962,717 A 10/1990 Tsumiyama
4,976,636 A 12/1990 Torigai et al.
4,984,542 A 1/1991 Rische et al.
4,989,563 A 2/1991 Fukutomi et al.
5,016,553 A 5/1991 Spencer
5,062,815 A 11/1991 Kobayashi
5,065,723 A 11/1991 Broughton et al.
5,074,810 A 12/1991 Hobbs et al.
5,076,385 A 12/1991 Terazawa et al.
5,090,929 A 2/1992 Rieben
5,110,310 A 5/1992 Hobbs
5,127,858 A 7/1992 Pelligrino et al.
5,142,473 A 8/1992 Davis
5,193,478 A 3/1993 Mardikian
5,203,727 A 4/1993 Fukui
5,244,425 A 9/1993 Tasaki et al.
5,253,604 A 10/1993 Bohlin
5,256,092 A 10/1993 Jones
5,261,844 A 11/1993 Shibata
5,265,572 A 11/1993 Kadomukai et al.
5,273,016 A 12/1993 Gillespie et al.
5,280,282 A 1/1994 Nagafusa et al.
5,314,362 A 5/1994 Nagahora
5,314,632 A 5/1994 Papke et al.
5,352,138 A 10/1994 Kanno
5,368,510 A 11/1994 Richard
5,389,016 A 2/1995 Nestvall
5,413,461 A 5/1995 Johnsen
5,423,277 A 6/1995 Gai
5,476,401 A 12/1995 Peterson et al.
5,492,493 A 2/1996 Ohkita
5,515,825 A 5/1996 Arai et al.
5,538,449 A 7/1996 Richard
5,582,125 A 12/1996 Matsumoto
5,586,535 A 12/1996 Syomura
5,607,332 A 3/1997 Kobayashi et al.
5,618,211 A 4/1997 Bourgoin
5,665,025 A 9/1997 Katoh
5,722,364 A 3/1998 Watanabe et al.
5,755,601 A 5/1998 Jones
5,777,412 A 7/1998 Yamamoto
5,797,371 A 8/1998 Nonaka
5,809,436 A 9/1998 Gregory
5,813,357 A 9/1998 Watson
5,833,501 A 11/1998 Jones
5,868,118 A 2/1999 Yoshioka
5,894,087 A 4/1999 Ohtuka et al.
5,906,524 A 5/1999 Ozawa et al.
5,967,862 A 10/1999 Motose
6,004,173 A 12/1999 Schott
6,015,317 A 1/2000 Hoshiba et al.
6,015,319 A 1/2000 Tanaka
6,019,090 A 2/2000 Ozawa
6,024,068 A 2/2000 Nakase et al.
6,030,261 A 2/2000 Motose
6,102,755 A 8/2000 Hoshiba
6,109,986 A 8/2000 Gaynor et al.
6,119,653 A 9/2000 Morikami
6,124,809 A 9/2000 Boudriau
6,159,059 A * 12/2000 Bernier et al. ..... 440/40
6,161,640 A 12/2000 Yamaguchi
6,205,987 B1 3/2001 Shigedomi et al.
6,231,410 B1 5/2001 Bernier et al.
6,336,833 B1 * 1/2002 Rheault et al. ..... 440/1
6,375,525 B1 4/2002 Kanno
6,390,862 B1 5/2002 Eichinger
6,405,669 B2 6/2002 Rheault et al.
6,415,764 B1 7/2002 Manchester
6,428,371 B1 8/2002 Michel et al.
6,520,147 B1 2/2003 Kanno
2001/0036777 A1 * 11/2001 Iida et al. ..... 440/84
2001/0051474 A1 12/2001 Matsuda et al.
2002/0014193 A1 2/2002 Rheault et al.
2002/0042233 A1 4/2002 Michel et al.
2002/0049010 A1 4/2002 Bernier et al.
2002/0112696 A1 8/2002 Watanabe
2002/0127926 A1 9/2002 Michel et al.
2002/0155766 A1 10/2002 Hattori
2003/0013354 A1 1/2003 Yanagihara

* cited by examiner

ENGINE CONTROL FOR WATERCRAFT

PRIORITY INFORMATION

This invention is based on and claims priority to Japanese Patent Application Nos. 2001-038202 and 2002-013828, filed Feb. 15, 2001 and Jan. 23, 2002, respectively, the entire contents of which are hereby expressly incorporated by reference.

BACKGROUND OF THE INVENTION

1. Field of the Invention

This invention relates to a control system for an engine of a watercraft.

2. Description of Related Art

Personal watercraft have become very popular in recent years. This type of watercraft is quite sporting in nature and carries one or more riders. A hull of the personal watercraft commonly defines a rider's area above an engine compartment. An internal combustion engine powers a jet propulsion unit that propels the watercraft by discharging water rearward. The engine lies within the engine compartment in front of a tunnel, which is formed on an underside of the hull. The jet propulsion unit is placed within the tunnel and includes an impeller that is driven by the engine.

A deflector or steering nozzle is mounted on a rear end of the jet propulsion unit for steering the watercraft. A steering mast with a handlebar is linked with the deflector through a linkage. The steering mast extends upwardly in front of the rider's area. The rider remotely steers the watercraft using the handlebar.

The engine typically includes at least one throttle valve disposed in an air intake passage of the engine. The throttle valve regulates the amount of air supplied to the engine. Typically, as the amount of air increases, the engine output also increases. A throttle lever or control is attached to the handlebar and is linked with the throttle valve(s) usually through a throttle linkage and cable. The rider thus can control the throttle valve remotely by operating the throttle lever on the handlebar.

SUMMARY OF THE INVENTION

In accordance with one aspect of the present invention, a jet propelled watercraft comprises an engine having at least one throttle valve. The throttle valve is movable between an idle position and a fully open position. A throttle operator, which is remotely positioned relative to the engine and is coupled to the throttle valve, is movable between first and second positions. This movement of the throttle operator causes the throttle valve to move between the idle and fully open positions, respectively. An engine control system comprises a first sensor configured to detect an operating state of the watercraft or the engine, a second sensor configured to detect a position of the throttle operator, and a throttle valve control mechanism that includes an actuator which cooperates with the throttle valve under at least one operating state of the watercraft or the engine. A controller of the engine control system communicates with the first and second sensors and with the throttle valve control mechanism. The controller is configured to activate the throttle valve control mechanism once the operating state of the watercraft or engine is greater than a predetermined state. The controller is also configured to leave active the throttle valve control mechanism at least when the throttle operator quickly moves to the first position so as to maintain the throttle valve between the idle and fully open positions.

In accordance with another one aspect of the present invention, a jet propelled watercraft comprises an engine having at least one throttle valve. The throttle valve is movable between a closed position and a fully open position, A throttle operator is remotely positioned relative to the engine and is coupled to the throttle valve. The throttle operator can be moved between first and second positions which cause the throttle valve to move between the closed and fully open positions, respectively. An engine control system cooperates with the engine to control engine speed under at least one operating condition of either the watercraft or the engine. The control system comprises a first sensor configured to detect an operating state of either the watercraft or the engine, a second sensor configured to detect a position of the throttle operator, a throttle valve control mechanism that includes an actuator selectively cooperating with the throttle valve under at least one operating state of the watercraft or the engine, and a controller communicating with the first and second sensors and with the throttle valve control mechanism. The controller is configured to activate the throttle valve control mechanism once the operating state of either the watercraft or engine is greater than a preset state, and the controller and throttle valve control mechanism are further configured to delay closure of the throttle valve at least when the throttle operator quickly moves to the first position.

In accordance with yet another aspect of the present invention, a method of controlling a watercraft having an engine is provided. The method involves sensing a first control parameter that is indicative of the operating state of either the watercraft or the engine, sensing a position of an operator used to control engine speed to determine at least when the operator is abruptly moved to an idle position, and activating a throttle valve control mechanism when the operating state of the watercraft or engine is greater than a preset operating state. Engine speed is maintained above an idle speed when the watercraft or engine is operating above the preset operating state and the operator is abruptly moved to the idle position.

Further aspects, features and advantages of this invention will become apparent from the detailed description of the preferred embodiments which follow.

BRIEF DESCRIPTION OF THE DRAWINGS

These and other features, aspects and advantages of the present invention will now be described with reference to the drawings of preferred embodiments, which are intended to illustrate and not to limit the invention. The drawings comprise 11 figures.

DETAILED DESCRIPTION OF PREFERRED EMBODIMENTS

Figure 1:
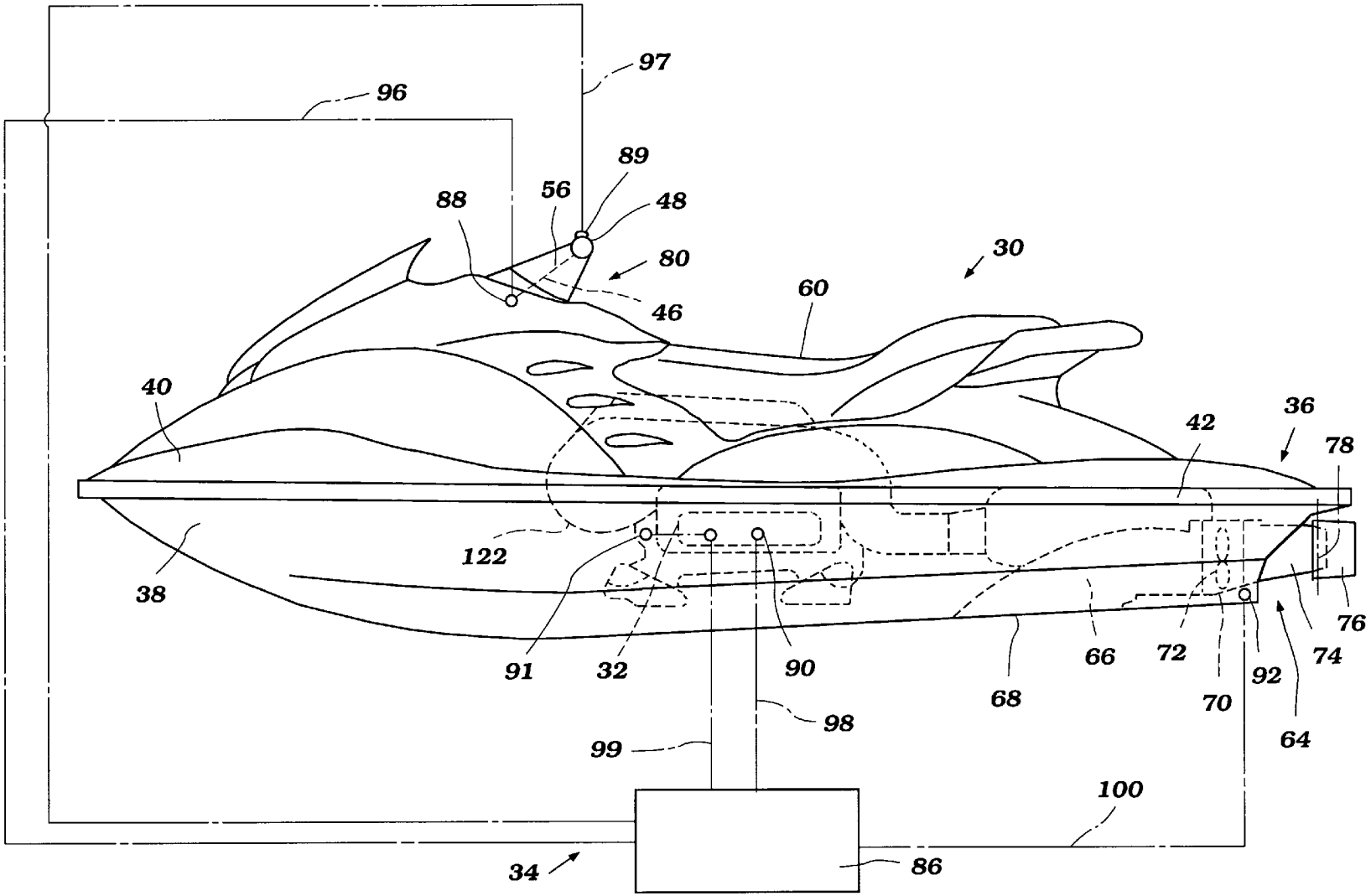
FIG. 1 is a side elevational view of a personal watercraft and schematically illustrates an engine control system configured in accordance with an embodiment of the present invention.

With primary reference to FIG. 1 and additionally to FIGS. 7–10, an overall configuration of a personal watercraft 30 will be described.

The watercraft 30 employs an internal combustion engine 32 and an engine control system 34 configured in accordance with a preferred embodiment of the present invention. This engine control system 34 has particular utility with a personal watercraft and, thus, is described in the context of the personal watercraft. The control system, however, can be applied to other types of watercraft as well, such as, for example, small jet boats and the like.

The personal watercraft 30 includes a hull 36 generally formed with a lower hull section 38 and an upper hull section or deck 40. The lower hull section may include one or more inner liner sections to strengthen the hull or to provide mounting platforms for various internal components of the watercraft. Both the hull sections 38, 40 are made of, for example, a molded fiberglass reinforced resin or a sheet molding compound. The lower hull section 38 and the upper hull section 40 are coupled together to define an internal cavity. A gunnel or bulwark 42 defines an intersection of both the hull sections 38, 40.

Figure 10:
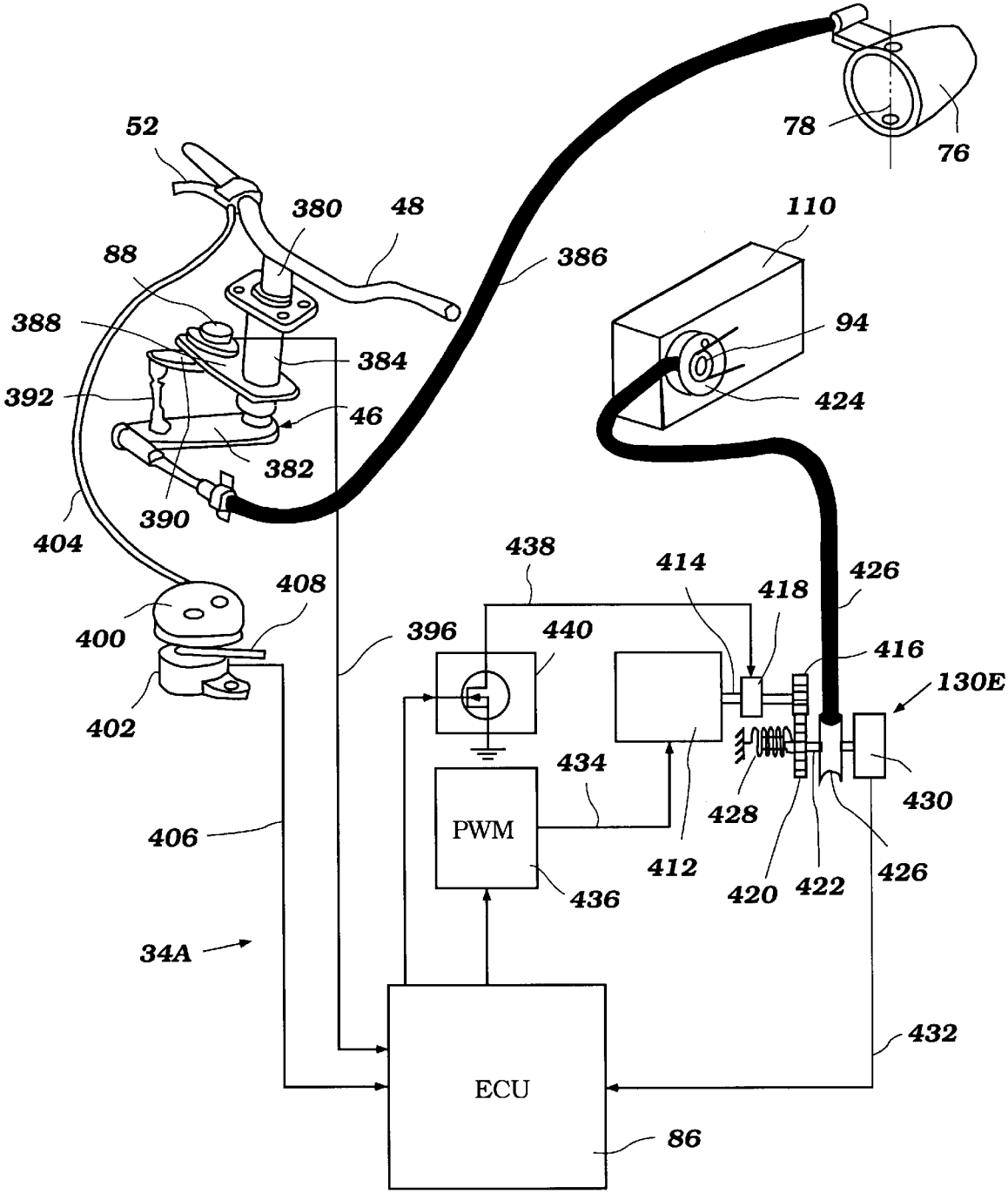
FIG. 10 is a schematic view showing another embodiment of the engine control system.

As seen in FIG. 1 and best seen in FIG. 10, a steering mast 46 extends generally upwardly almost atop the upper hull section 40 to support a handlebar 48. The handlebar 48 is provided primarily for a rider to control the steering mast 46 so that a thrust direction of the watercraft 30 is properly changed. The handlebar 48 also carries other control devices such as, for example, a throttle lever 52 for manually operating throttle valves 54 (FIGS. 4–5, and 7–9) of the engine 32. The throttle lever 52 is one type of a throttle operator that can be used with the present engine control system 32 and is remotely positioned relative to the engine 32. A rider can move the throttle lever 52 between a first, fully-released position, which corresponds to an idle position of the throttle valves, and a second, fully-depressed position, which corresponds to a fully open position of the throttle valves. In the fully open position, the throttle valves need not be wide open for some engine designs. In the illustrated arrangement, the steering must 46 is covered with a padded steering cover member 56.

A seat 60 extends longitudinally fore to aft along a centerline of the hull 36 at a location behind the steering mast 46. This area, in which the seat 60 is positioned, is a rider's area. The seat 60 has generally a saddle shape so that the rider can straddle it. Foot areas are defined on both sides of the seat 60 and at the top surface of the upper hull section 40. A cushion, which has a rigid backing and is supported by a pedestal section of the upper hull section 40, forms part of the seat 60. The pedestal forms the other portion of the seat. The seat cushion is detachably attached to the pedestal of the upper hull section 40. An access opening is defined on the top surface of the pedestal, under the seat cushion, through which the rider can access an engine compartment defined in an internal cavity formed between the lower and upper hull sections 38, 40. The engine 32 is placed in the engine compartment. The engine compartment may be an area within the internal cavity or may be divided from one or more other areas of the internal cavity by one or more bulkheads.

A fuel tank is placed in the internal cavity under the upper hull section 40 and preferably in front of the engine compartment. The fuel tank is coupled with a fuel inlet port positioned at a top surface of the upper hull section 40 through a filler duct. A closure cap closes the fuel inlet port.

At least a pair of air ducts or ventilation ducts is provided on both sides of the upper hull section 40 so that the ambient air can enter the internal cavity through the ducts. Except for the air ducts, the engine compartment is substantially sealed so as to protect the engine 32 and a fuel supply system (including the fuel tank) from water.

A jet propulsion system 64 propels the watercraft 30. The jet propulsion system 64 includes a tunnel 66 formed on the underside of the lower hull section 38. In some hull designs, the tunnel is isolated from the engine compartment by a bulkhead. The tunnel 66 has a downward facing inlet port 68 opening toward the body of water. A jet pump unit 70 is disposed within a portion of the tunnel 66 and communicates with the inlet port 68. An impeller 72 is rotatably supported within the housing of the unit 70. An impeller shaft extends forwardly from the impeller 72 and is coupled with a crankshaft of the engine 32 so as to be driven by the crankshaft. The rear end of the unit 70 includes a discharge nozzle 74. A deflector or steering nozzle 76 is affixed to the discharge nozzle 74 for pivotal movement about a steering axis 78 that extends generally vertically. A cable connects the deflector 76 with the steering mast 46 so that the rider can rotate the deflector 76 about the steering axis 78. A steering mechanism 80 for the watercraft thus preferably comprises the steering mast 46, the handlebar 48, the cable and the deflector 76.

When the crankshaft of the engine 32 drives the impeller shaft and hence the impeller 72 rotates, water is drawn from the surrounding body of water through the inlet port 68. The pressure generated in the jet pump unit 70 by the impeller 72 produces a jet of water that is discharged through the discharge nozzle 74 and the deflector 76. The water jet produces thrust to propel the watercraft 30. Maneuvering of the deflector 76 changes the direction of the water jet, thus providing forces having both lateral and longitudinal vectors to affect the heading of the watercraft 30. The rider thus can turn the watercraft 30 in either a right or a left direction by operating the steering mechanism 80.

As schematically shown in FIG. 1, the engine control system 34 preferably includes an ECU (electronic control unit) or control device 86, a steering position sensor 88, a throttle lever position sensor 89, a throttle position sensor 90, an engine rpm sensor 91, and a watercraft velocity sensor 92. The ECU 86 is preferably mounted on the engine 32 or disposed in proximity to the engine 32. The steering position sensor 88 is preferably positioned adjacent to the steering mast 46 so as to sense an angle of the steering mast 46 when the rider operates it. The throttle lever position sensor 89 is positioned at the throttle lever 52 or is located along the cable and/or linkage that connects the throttle lever 52 to the throttle valve 54. For example, the throttle lever position sensor 89 could be attached to the throttle pulley 120 (see FIG. 4A), which is directly connected to the throttle lever 52 by a cable 118 in the illustrated embodiment. The throttle position sensor 90 is preferably affixed at one end of throttle valve shafts 94 (FIGS. 4A and 4B) so as to sense a position of the throttle valves 54. The engine rpm sensor may be located at an end of the crankshaft or along the impeller shaft. The watercraft velocity sensor 92 is preferably located at a rear bottom portion of the watercraft 30, which is submerged during normal running conditions of the watercraft 30. The respective sensors 88, 89, 90, 91, 92 are connected to the ECU 86 through signal lines 96, 97, 98, 99, 100, respectively. Of course, the signals can be sent through hard-wired connections, emitter and detector pairs, infrared radiation, radio waves or the like. The type of signal and the type of connection can be varied between sensors or the same type can be used with all sensors.

Figure 2:
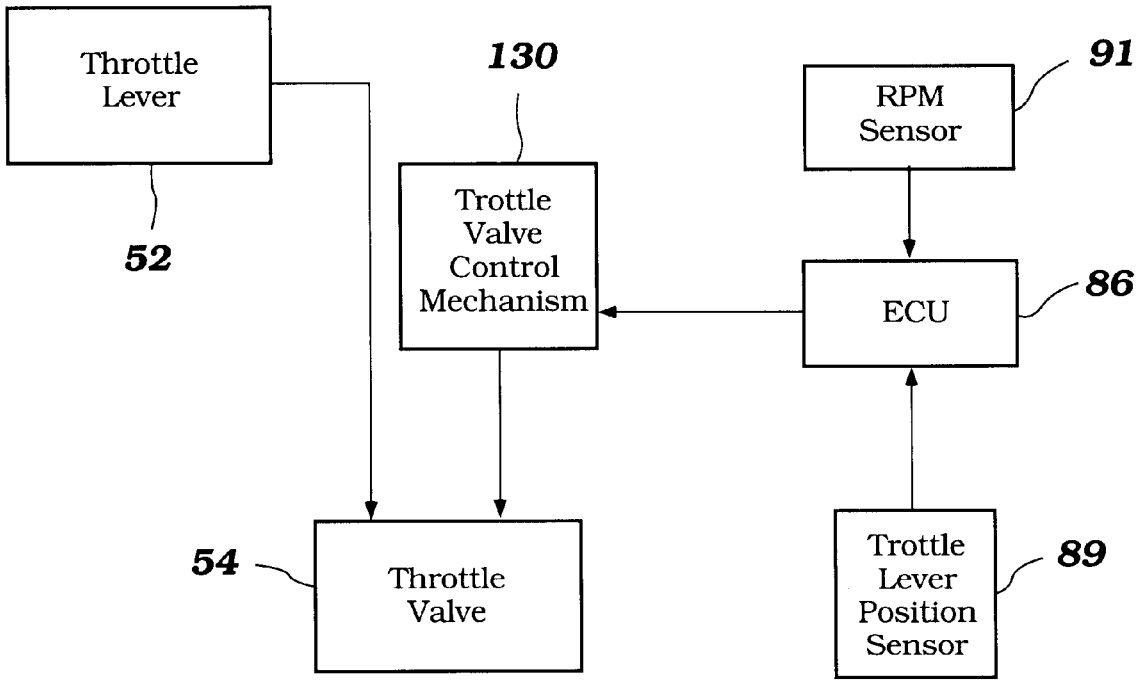
FIG. 2 is a system diagram of the engine control system.
Figure 3:
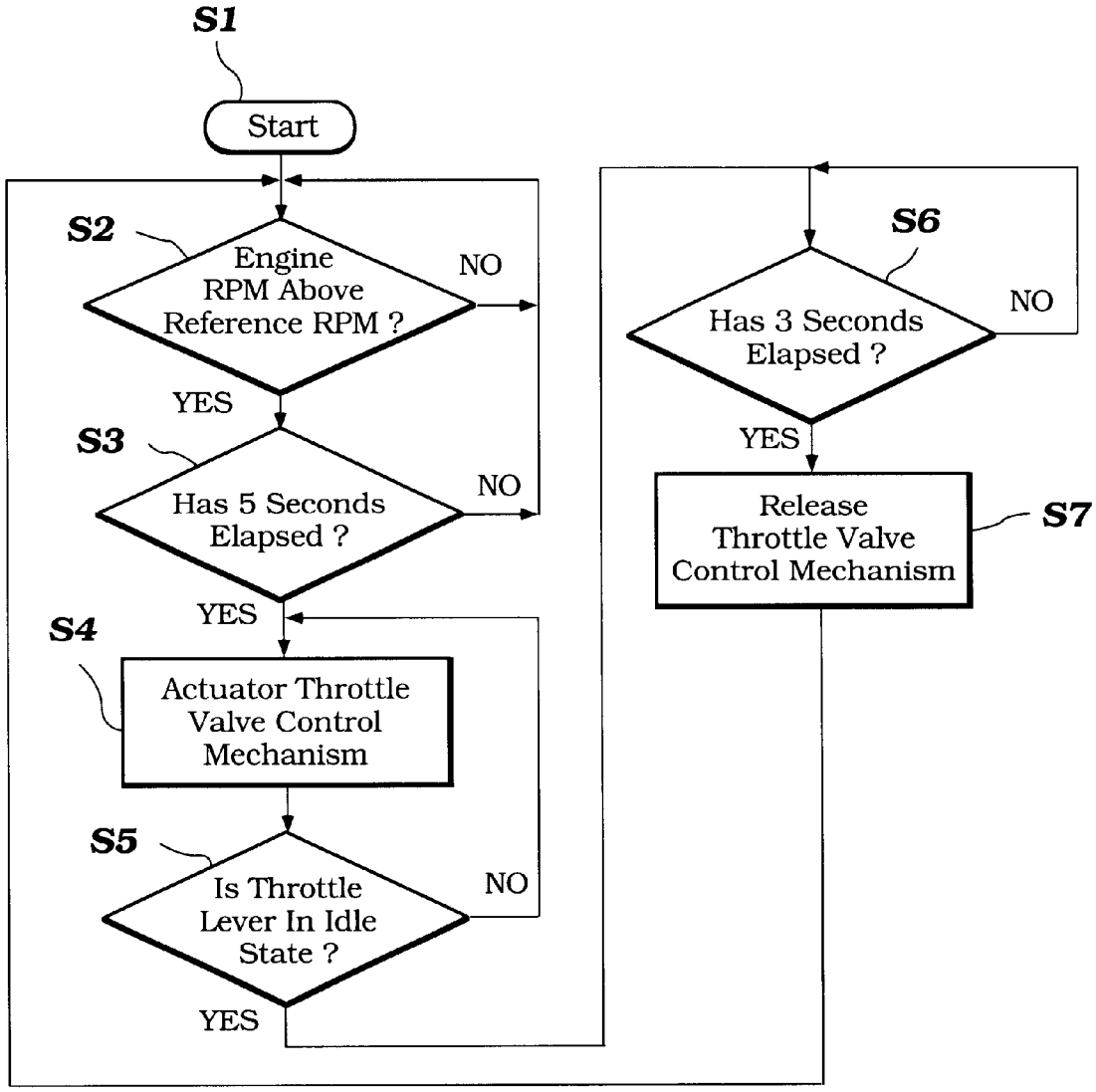
FIG. 3 is a control routine for the engine control system.

The illustrated control system 34 preferably is configured as schematically shown in FIG. 2 and operates in accordance with a control routine shown in FIG. 3, although other control routines are applicable inasmuch as they comply with the control strategy of the present invention. The exemplary control routine as well as the control system 34 will be described in greater detail shortly.

The engine 32 preferably operates on a two-cycle crankcase compression principle and has three cylinders spaced apart from one another along the longitudinal centerline. The illustrated engine, however, merely exemplifies one type of engine on which various aspects and features of the present invention can be used. The invention can be used with engines having other number of cylinders, having other cylinder arrangements, other cylinder orientations (e.g., upright cylinder banks) and operating on other combustion principles (e.g., four cycle or rotary).

The engine 32 generally has a typical and conventional construction. The engine 32 includes a cylinder block defining three cylinder bores in which pistons reciprocate. At least one cylinder head member is affixed to the upper end of the cylinder block to close respective upper ends of the cylinder bores and defines combustion chambers with the cylinder bores and the pistons. Separate cylinder heads for each cylinder bore also can be used. A crankcase member is also affixed to the lower end of the cylinder block to close the respective lower ends of the cylinder bores and to define crankcase chambers with the cylinder block. The crankshaft is rotatably connected to the pistons through connecting rods and is journaled for rotation within the crankcase. The cylinder block, the cylinder head and the crankcase member preferably are made of aluminum alloy and together define an engine body 102.

Engine mounts 104 (FIG. 7A) extend from both sides of the engine body 102. The engine mounts 104 preferably include resilient portions made of, for example, rubber material. The engine body 102 is mounted on the lower hull section 38 (or possibly on the hull liner) by the engine mounts 104 so that vibration of the engine body 102 is inhibited from conducting to the hull section 38.

Figure 8:
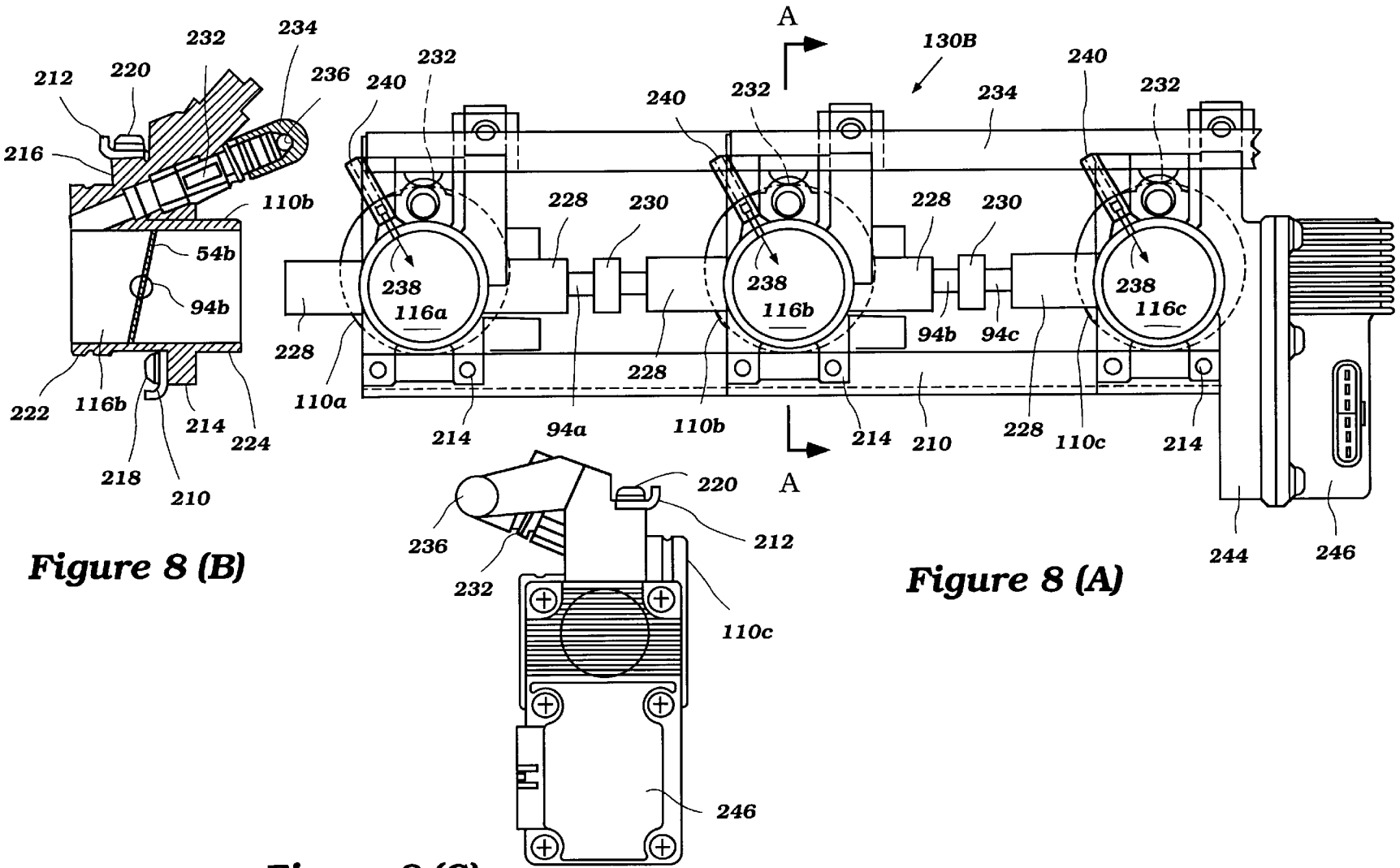
FIG. 8(A) is a side view of another throttle valve control mechanism configured in accordance with another preferred embodiment of the present invention that can be used in the engine control system of FIG. 2.
FIG. 8(B) is a sectional view of the throttle valve control mechanism taken along the line A—A of FIG. 8(A).
FIG. 8(C) is a front view of the throttle valve control mechanism.
Figure 9:
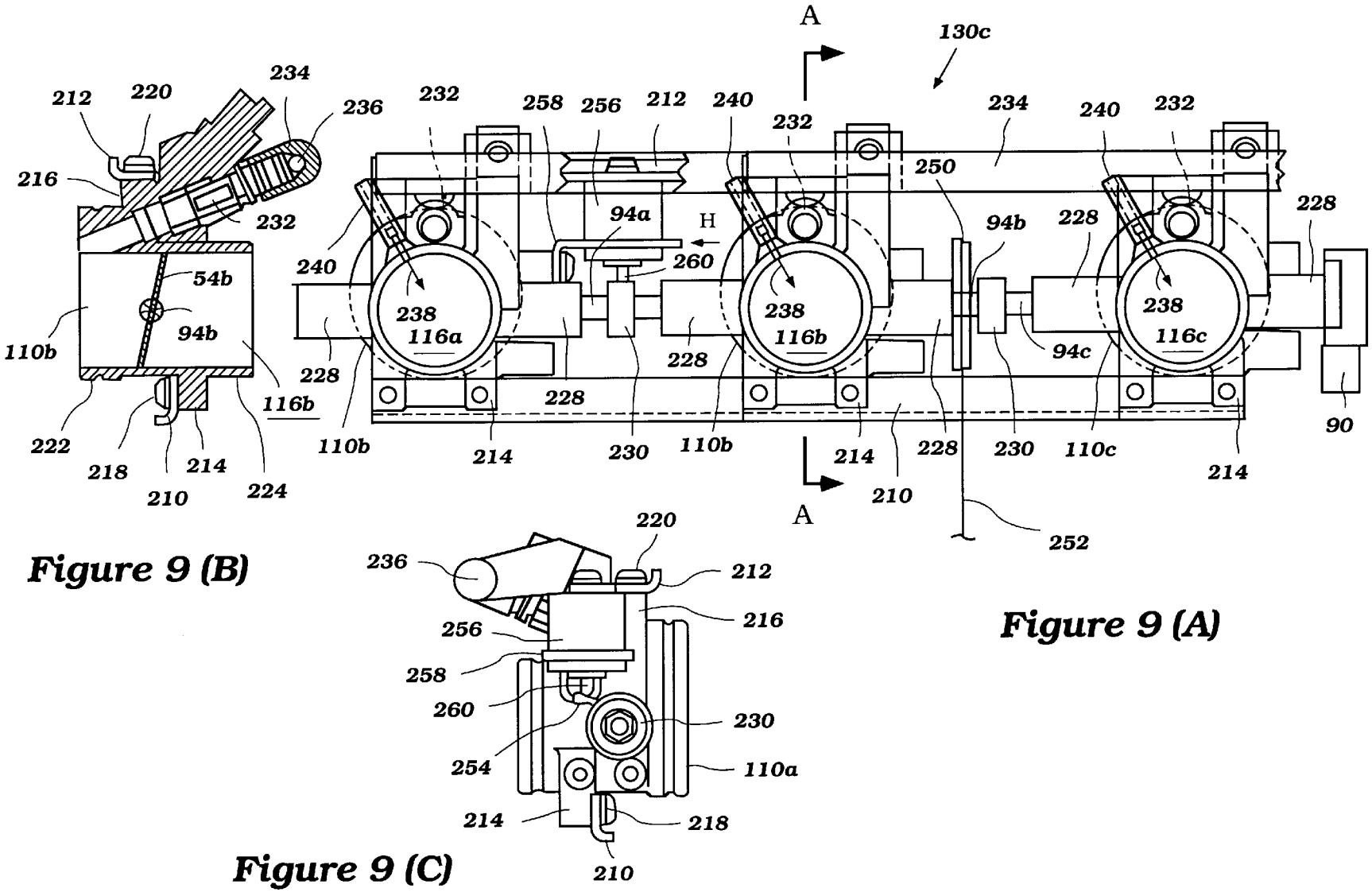
FIG. 9(A) is a side view of an additional throttle valve control mechanism configured in accordance with an additional preferred embodiment of the present invention that can be used with the engine control system of FIG. 2.
FIG. 9(B) is a sectional view of the throttle valve control mechanism taken along the line A—A of FIG. 9(A).
FIG. 9(C) is a front view of a control structure including a solenoid actuator looked in the direction of the arrow H.

The engine 32 preferably includes an air induction system 108 to introduce air to the combustion chambers. As seen in FIG. 8, in the illustrated embodiment, the air induction system is disposed on the starboard side of the engine body 102. The induction system 108 includes one or more throttle bodies 110 affixed to the crankcase member, and a plenum chamber member or air intake box 112. The plenum chamber member 112 defines a plenum chamber 114 into which the air in the engine compartment enters. Preferably, the plenum chamber 114 smoothes the intake air flow and attenuates intake noise. The throttle bodies 110 each communicate with a respective individual chamber within the crankcase that communicates with one of the combustion chambers through scavenge passages defined within the engine body 102. The throttle bodies 110 define intake passages 116 through which the air flows to the individual crankcase chambers.

The respective throttle valves 54 are disposed within the intake passages 116 so as to regulate the amount of air passing through the intake passages 116. Because the throttle valve shafts 94 are journaled on the throttle bodies 110 for rotatable movement about axes of the respective valve shafts 94, the respective throttle valves 54 can rotate to change opening degrees thereof. The foregoing throttle lever 52 preferably is connected to the throttle valve shafts 94 through a throttle wire or cable 118. In the illustrated embodiment, the individual throttle valve shafts 94 are linked together so that the throttle wire 118 can be connected with only one of the shafts 94 or at a point along the resulting throttle shaft linkage. As seen in FIG. 4B, the throttle valve shaft 94 has a pulley 120 and the throttle wire 118 is affixed to the pulley 120 so as to coil around it. By operating the throttle lever 52, the opening degrees of the respective throttle valves 54 change so as to regulate air flow to the combustion chambers. In the illustrated embodiment, the throttle pulley 120 and the cable 118 provide a throttle drive mechanism that link the throttle lever 52 to the throttle valve assembly.

As described above, one of the throttle valve shafts 94 in the illustrated embodiment shown in FIG. 4B has the throttle position sensor 90 at one end thereof. The throttle position sensor 90 thus can sense an angular position of each throttle valve 54, i.e., an opening degree of each throttle valve 54.

The throttle valves 54 can be closed so as to bring the engine 32 to an idle state. Even at this idle state, the engine 32 still needs a small amount of air to maintain the idle state. The throttle valves 54 thus usually lie slightly skewed or have a bypass opening to permit a small amount of air to pass through the intake passage 116 when in an idle, "closed" position. Alternatively, an idle air supply mechanism can be provided such as a sub-passage bypassing the throttle valves 54. A control valve for controlling the idle air amount can be provided at the sub-passage.

The engine 32 also includes a fuel supply system. The fuel supply system includes the fuel tank, a charge forming device and a fuel delivery mechanism that connects the fuel tank with the charge forming device. The charge forming device can take various structures such as a carburetor, a fuel injection mechanism or the like. If the fuel injection mechanism is employed, fuel can be sprayed either directly or indirectly to the combustion chambers. In the illustrated embodiment, an indirect fuel injection mechanism is employed.

The fuel injection mechanism includes one or more fuel injectors directed toward the respective intake passages and one or more fuel pumps to pressurize the fuel delivered to the fuel injectors. Each fuel injector has an injection nozzle that is exposed to the intake passage. The injection nozzle preferably is opened and closed by an electromagnetic unit that is slideable within an injection body. The electromagnetic unit has a solenoid coil controlled by electrical signals. When the nozzle is opened, pressurized fuel is sprayed into the intake passage. The sprayed fuel is drawn to the combustion chambers with the air passing through the intake passages.

The ECU 86 preferably controls an amount of fuel sprayed into each intake passage 116. Alternatively, another ECU can control the fuel injector because a pressure regulator strictly regulates the fuel pressure, the ECU 86 can vary the fuel amount by varying the duration of each injection. The ECU also can advance injection timing and initiation timing in order to increase the engine output.

The engine 32 further includes an ignition or firing system. Spark plugs of the ignition system are affixed to the cylinder head. A spark gap of each spark plug is exposed within an associated combustion chamber. Each spark plug ignites an air/fuel charge at an ignition timing controlled by the ECU or by another ECU. The ignition system preferably has an ignition mechanism including an ignition coil and an igniter. The ignition coil preferably is a combination of a primary coil element and a secondary coil element that are wound around a common core. The secondary coil element is connected to the spark plugs while the primary coil element is connected to the igniter. The primary coil element also is coupled with a power source (e.g. a battery). The igniter abruptly cuts off the current flow in response to an ignition timing control signal from the ECU. A high voltage current flow consequently occurs in the secondary coil element. The high voltage current flow forms a spark at each spark plug. The ECU 86 controls an ignition timing of the spark plugs in this manner.

The engine 32 further includes an exhaust system to discharge burnt charges, i.e., exhaust gases, from the combustion chambers. Exhaust ports are defined in the cylinder block and communicate with the associated combustion chambers. An exhaust manifold is connected to the cylinder block and communicates with the exhaust ports. Multiple exhaust conduits 122 (FIG. 1) are further coupled with the exhaust manifold in series so as to extend around the engine body 102 and then toward the tunnel 66. A discharge exhaust conduit 122 is connected to the tunnel 66 so that the exhaust gases are discharged into the tunnel 66 in a known manner.

With reference to FIGS. 1–10, and especially to FIGS. 2–6, the control system 34 and an exemplary control routine will now be described. It is to be noted that the control system 34 may be in the form of a hard wired feedback control circuit or may be constructed of a dedicated processor and a memory for storing a computer program and data. Additionally, the control system 34 may be constructed of a general purpose computer having a general purpose processor and the memory for storing the computer program for performing the control routine. Preferably, however, the control system 34 utilizes the engine ECU 86, which may be constructed in any of the above-mentioned forms.

FIG. 2 illustrates a block diagram of the control system 34 in which the ECU 86 controls a throttle valve control mechanism 130. In the illustrated embodiment, the ECU receives signals from the throttle lever position 89 sensor and the engine rpm sensor 91. It also preferably receives signals from the other sensor, but need not to for the purposes of the control routine illustrated in FIG. 3. Generally, a throttle opening angle (i.e., throttle position) will correspond with a given engine rpm, although variances are expected due to, among other factors, engine load and air/fuel mixture. The ECU 86 controls the throttle valve control mechanism 130 which may be activated to control the opening angle of the throttle valves 54 and, hence, to control the engine output (for at least some period of time or until certain control parameters occur). The throttle valves 54 are also controlled by the user-controlled throttle lever 52 mounted on the handlebar of the watercraft 30 which is the usual circumstance; however, under some circumstances (described below) the throttle valve control mechanism temporarily overrides the user-controlled mechanism. Thus, the throttle valve 54 opening angle is controlled by the throttle lever 52, yet is still under the overriding control of the ECU via the throttle valve control mechanism 130. In this way, the ECU 86 may override the throttle opening angle provided by the throttle lever 52, based upon signals received either from the rpm sensor 91 and the throttle lever position sensor 89. The throttle valve control mechanism 130 is preferably a mechanical control disposed adjacent the throttle valve shaft 94 and will be discussed in greater detail with specific reference to FIGS. 4 and 5.

FIG. 3 illustrates an exemplary control routine for the ECU 86. The routine begins at S1 when the engine is started. At S2, the ECU receives a signal from the rpm sensor 91 and determines if the engine speed is greater than a reference rpm, which may be, for example, within the range of from about 2,000 rpm to about 5,000 rpm, and more preferably within the range of from about 3,500 to about 4,500, and in one embodiment, is 4,000 rpm. This comparison is repeatedly carried out until the engine rpm sensor 91 reports a value above the reference rpm. The ECU 86 then proceeds, at S3, and determines if the engine rpm is maintained at an rpm above the reference rpm for a given time, for example, but without limitation, 3–5 seconds. If the engine rpm has not been maintained for a period of time longer than the reference time, the ECU 86 continues to receive signals from the rpm sensor 91 until the reported value is greater than the reference rpm. If the engine rpm maintains a speed above the reference rpm for greater than the predetermined amount of time, at S4, the ECU sends instructions to actuate the throttle valve control mechanism 130. At S5, the ECU 86 then monitors the position of the throttle lever 52 via the throttle lever sensor 89 to determine when the throttle lever 52 returns to an idle position. Once the throttle lever 52 is returned to an idle position, the ECU 86 receives the corresponding signal from the throttle lever sensor 89 and, at S5, waits for a predetermined amount of time to elapse, such as, for example, but without limitation, 3 seconds. During this time, the throttle valve control mechanism 130 holds open the throttle valves to maintain the engine at a speed above idle, such as, for example, but without limitation, at 3000 rpm. Once the predetermined amount of time elapses, the ECU 86 releases (i.e. deactivates) the throttle valve control mechanism 130 at S7 and the throttle valve 54 is allowed to return to a closed, idle position.

It should be understood that the above routine can be part of a larger control routine and can include additional control step, including those discussed below in connection with the control routine diagramed in FIG. 11. In addition, the control parameter used to determine when to activate the throttle valve control mechanism 130 can be any parameter that is indicative of the operating state of the watercraft 30 or the engine 32. For example, control parameters, such as, for example, watercraft speed or throttle position can be used in addition or in the alternative to engine speed. In addition, the control parameter used to determine when to turn off the throttle control mechanism 130 can involve parameters other than time, such as, for example, steering angle, watercraft speed, and engine speed. For instance, the ECU can determine if the steering angle is less than a preset angle (e.g., 30 degrees), and if so, can cause the throttle valve control mechanism 130 to release the throttle valve 54. This can be done in addition or in the alternative to a timing control.

The act of maintaining engine speed above idle also can involve either holding a generally constant speed (see, e.g., graph 171 in FIG. 6) or gradually decreasing the engine speed at a rate slower than normal if the throttle valve were allowed to closed under spring bias (as usually is the case). A gradual decrease can take the throttle valve back to its idle position at the end of the controlled closing process (under the control of the throttle valve control mechanism) or can slow the rate of closure until the end of the controlled closing process, at which time the throttle valve will close (i.e., return to its idle position) under the spring bias.

Figure 4A:
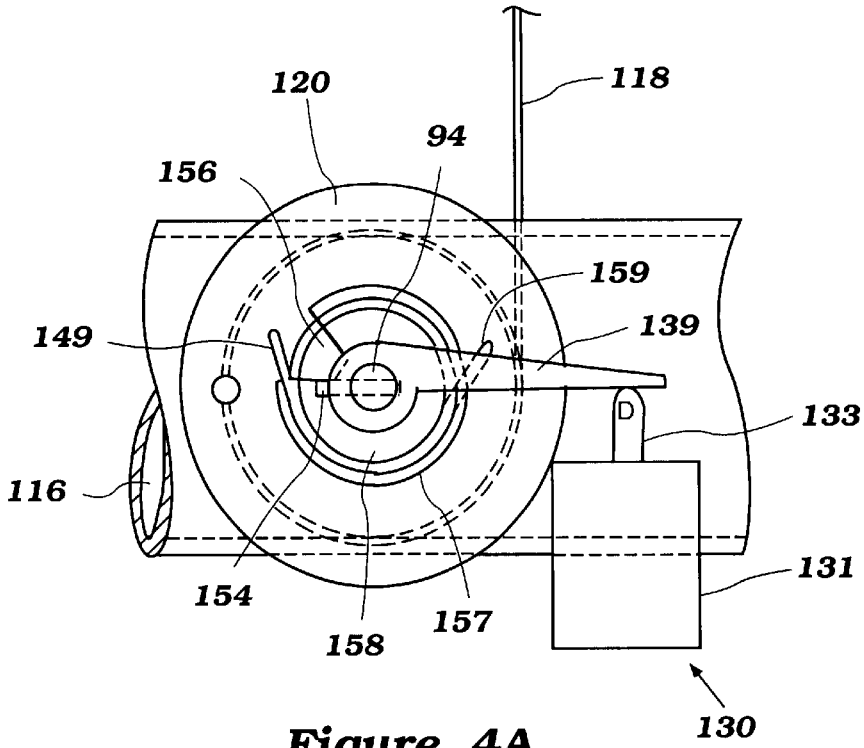
FIG. 4(A) illustrates the air intake pathway with a throttle valve control mechanism of the engine control system.
Figure 4B:
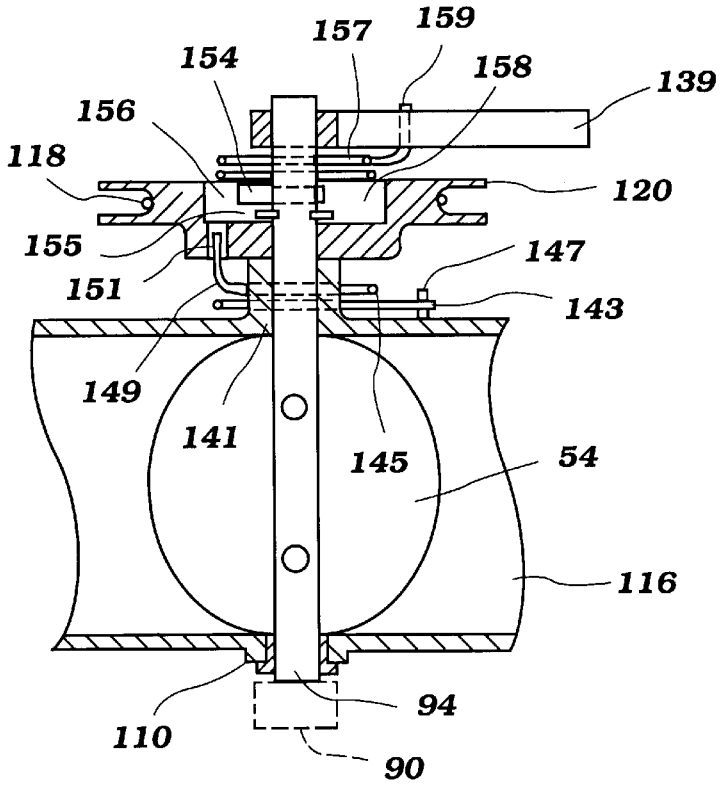
FIG. 4(B) shows a sectional view of the same mechanism taken generally along a central axis of the intake pathway.

FIGS. 4A and 4B illustrate an embodiment of a throttle valve control mechanism 130. A throttle valve stop housing 131 houses an actuator, which may be a solenoid, a step motor, or other similar device to displace a slidable plunger 133 protruding from the throttle stop housing 131. In one variation, the plunger 133 can be replaced by a linkage assembly. The throttle shaft 94 fixedly carries a throttle shaft lever 139 that is permanently oriented relative to the throttle valves 54. At least one throttle body 110 includes a protruding boss 141 having a first torsion spring 145 mounted circumferentially thereon. As seen in FIG. 4B, a static end 143 the spring 145 is held in place, such as by a flange 147 protruding from the throttle body 110. The biasing end 149 of the spring 145 fits within a hole or notch 151 formed in pulley 120, such that the spring 145 biases the pulley to rotate in a direction corresponding with a closed throttle position. The pulley 120 is rotatably attached to the throttle valve shaft 94, and is retained thereon by a clip 155; however, under normal conditions, the pulley 120 is biased to rotate with the throttle valve shaft 94 by a second torsion spring 157. The pulley 120 has one end of the second torsion spring 157 connected to it. The second torsion spring 157 wraps around the throttle valve shaft 94 and has a second biasing end 159 projecting adjacent to the throttle shaft lever 139, such that the biasing end 159 of the second spring 157 biases the throttle shaft lever 139 and the pulley 120 to rotate together. The result is a lost motion coupling that allows concurrent rotation of the throttle shaft lever 139, throttle shaft 94, and pulley 120, but also permits the pulley 120 to return to the idle position while the throttle lever 139 and throttle shaft are held open by the throttle valve control mechanism 130. When the throttle valve control mechanism 130 is activated, the plunger 133 inhibits the throttle shaft lever 139 for rotating with the pulley 120 back towards an idle position under the bias of the first torsion spring 145. Consequently, the throttle valve control mechanism 130 prevents the throttle valve lever 139 from rotating to its maximum range of movement corresponding with a throttle valve closed position. The throttle valve 54 is maintained in a partially opened position and the engine is maintained at an output level above idle.

Figure 5A:
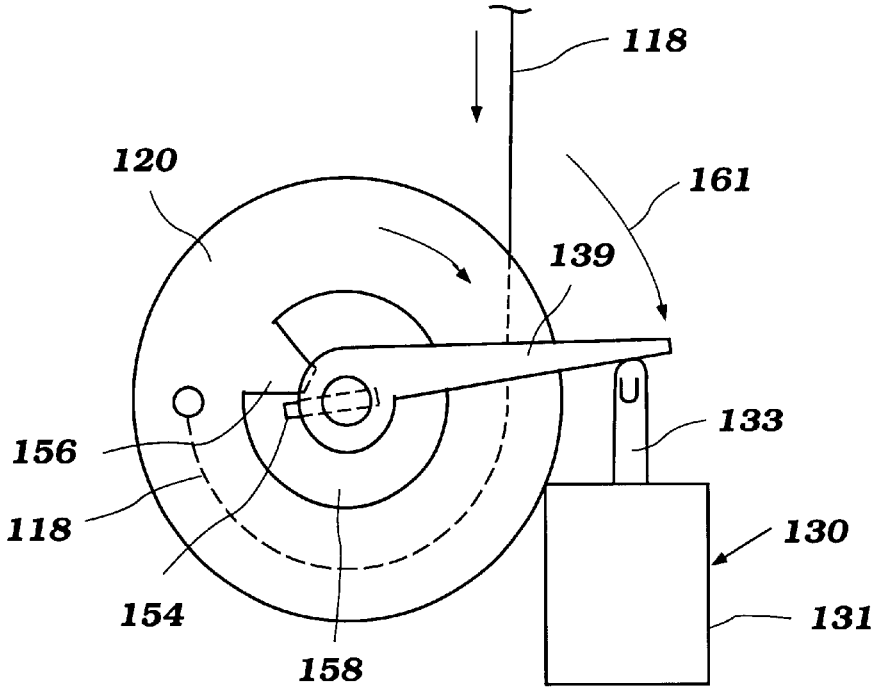
FIG. 5(A) illustrates a plan view of the throttle valve control mechanism of FIG. 4(A) in an active state and engaged with a throttle lever of the mechanism, thereby maintaining a throttle opening angle above idle.
Figure 5B:
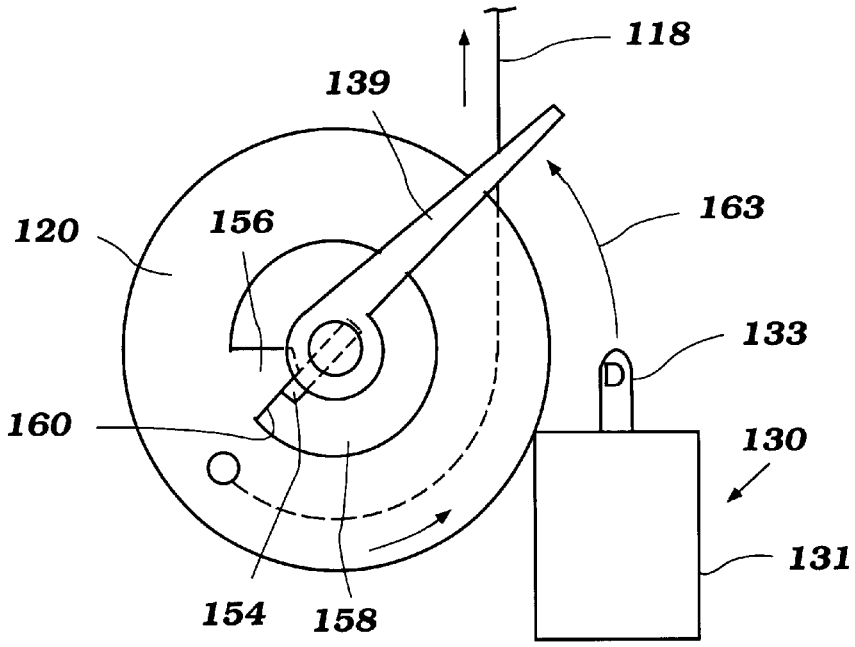
FIG. 5(B) illustrates a plan view with the mechanism deactivated and disengaged.

In the illustrated embodiment, as best seen in FIGS. 5A and 5B, a drive arrangement is provided as part of the lost motion coupling to cause the throttle pulley 120 to rotate the throttle shaft 94 in a direction 163 opening the throttle valve 54. The pulley 120 contains an inward protrusion 156 that projects toward the rotational axis of the pulley 120 and that nests within a pocket 158 formed into the side of the pulley 120. A pin 154 is mounted in the throttle valve shaft 94 and perpendicular thereto such that it protrudes into the pocket 158. In one embodiment, the pulley 120 is not constrained to rotate with the throttle valve shaft 94, but is free to rotate independently thereof. However, when the throttle lever 52 is depressed and the throttle wire 118 imparts rotational motion to the pulley 120, the inward protrusion 156 has a contacting surface 160 that contacts the pin 154 and causes the throttle shaft 94 to rotate. In this way, the throttle opening angle is controlled directly by the throttle lever 52.

The first and second torsion springs 145, 157 can, in addition or in the alternative to the drive arrangement, have different spring constants, such that the spring constant of the first torsion spring 145 is greater than the spring constant of the second spring 157. This type of lost motion mechanism allows the pulley 120 to rotate about the throttle valve shaft 94 independently of the shaft lever 139. Therefore, when the throttle lever 52 mounted on the handlebar is released and returns to a position corresponding with an engine idle position, the pulley is able to rotate to accept the slack of the throttle cable 118, while the throttle valve 54 is forced to maintain a partially opened position (i.e. held partially open). Accordingly, once the ECU 86 activates the throttle valve control mechanism 130 and the plunger 133 is extended, even if an operator releases the throttle lever 52, the throttle valve 54 remains in a partially opened position to provide a thrust above idle to provide for sharp steering of the watercraft. As described in relation to FIG. 3, the ECU 86 deactivates the throttle valve control mechanism 130 after a prescribed amount of time and the engine is allowed to return to an idle state. In another variation, the ECU could turn off the throttle valve control mechanism 130 after the watercraft slows to a particular speed or the engine speed (rpm) slows to a particular lever.

The torsion springs 149, 157 (FIG. 4B) bias the pulley in a clockwise direction 161, which corresponds to a direction that tends to close the throttle valves 54 and place the engine in an idle state. (It should be understood that other types of biasing devices can be used in place of the torsion springs 149, 157 used in the illustrated embodiment.) The clockwise biasing 161 also tensions the throttle wire 118 thus providing some resilience to the throttle lever 52 on the handlebar 48. The throttle wire 118 is connected at one end to the throttle lever 52 and the other end to the pulley 120. The throttle wire 118 is preferably at least partially wound around the pulley 120 so as to translate a linear displacement of the wire 118 into an angular displacement of the pulley 120.

As shown in FIG. 5B with continued reference to FIGS. 4A and 4B, when the throttle lever 52 is depressed, the throttle wire 118 is tensioned, which causes the pulley 120 to rotate about its center, thereby rotating the throttle valve shaft 94 and the throttle valve 54 located thereon. As the throttle lever 52 is released, such as in FIG. 5A, the biasing of the torsion springs 149, 157 cause the pulley 120, throttle shaft lever 139, throttle shaft 94, and throttle valve 54 to rotate in unison to return the throttle valve 54 to a position corresponding with an engine idle state. However, the throttle control mechanism 130 is under the control of the ECU 86, and when activated, interferes with the rotational movement of the throttle valve 54 by inhibiting further clockwise movement of the throttle shaft lever 139. The throttle valve control mechanism 130 includes the plunger 133 that, when extended, prevents the throttle valve 54 from fully closing and thus returning the engine 32 to an idle state. In this way, the engine is maintained at an rpm level elevated above an idle rpm level to provide higher thrust to allow a watercraft operator to turn the watercraft more sharply. The length of the plunger 133 directly controls the throttle valve 54 position, and hence, the engine rpm. By simply varying the length of the extended plunger 133, the maintained engine rpm may also be varied. Similarly, the relative position of the shaft lever 139 vis-a-vis the throttle shaft 94 position at idle can be changed to increase or decrease the rpm level of the engine 32 when the plunger 133 is deployed. It is anticipated that the engaged throttle valve control mechanism 130 will, at least, provide an engine rpm above an idle rpm.

As is shown in relation to FIG. 5B, the throttle valve lever 139 is still rotatable in an rpm increasing direction 163 regardless of the engaged or disengaged status of the throttle valve control mechanism 130.

When the throttle lever 52 is released, the pulley 120 is biased to rotate in a direction 161 corresponding with a throttle closed position, thus drawing in the slack in the throttle wire 118. The throttle valve shaft 94 is able to rotate independently of the pulley 120, but is also biased in a direction corresponding with a throttle closed position by a spring 157. If the throttle valve control mechanism 130 has been actuated and the plunger 133 has been positioned into the path of the throttle shaft lever 139, the plunger interferes with further rotational movement of the throttle shaft lever 139. However, the pulley 120 is free to continue to rotate as shown in FIG. 5A. Specifically, the inward protrusion 156 no longer contacts the pin 154 and the pulley is free to continue its rotation to draw in any slack in the throttle wire 118.

Figure 6:
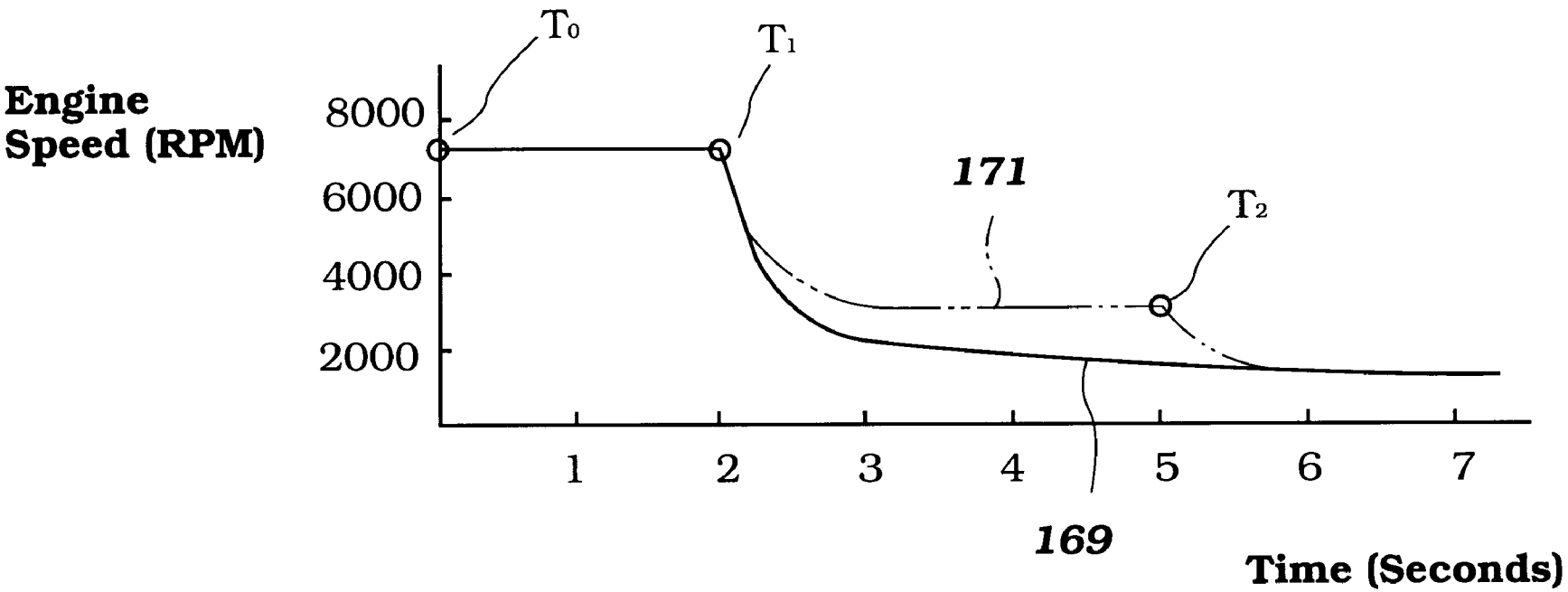
FIG. 6 is a graph showing the relationship between engine rpm and time under two control conditions: (1) with the throttle valve control mechanism active and engaged for a period of time and (2) with the throttle valve control mechanism deactivated and disengaged.

The effect of the throttle valve control mechanism 130 being activated on the engine rpm is graphically depicted in relation to FIG. 6. At an initial time T0, the engine rpm is above a reference rpm, such as for example, 4000 rpm. While this diagram depicts the engine rpm as a steady value, this is not a requirement for the throttle valve control mechanism 130 to become activated. As described relative to FIG. 3, the throttle valve control mechanism 130 is activated when the engine rpm maintains a speed above a reference speed for a given amount of time. A first reference line 169 shows the normal engine behavior when the throttle lever 52 abruptly returns to a position corresponding with an engine idle state at T1. Generally, time is required for the motion of the throttle lever 52 to translate through the throttle system and eventually close the throttle valves 54. Furthermore, the engine does not abruptly return to an idle state, as the engine inertia must be dissipated over time. Accordingly, the first reference line 169 shows a gradual decrease in engine rpm between the time the throttle lever 54 is released at T1 until the engine returns to an idle state which may take on the order of several seconds.

A second reference line 171 denotes how the engine rpm is affected by the activation of the throttle valve control mechanism 130. When the throttle lever 52 is abruptly released at T1, the engine rpm begins to decrease, generally following the first reference line 169, until the throttle valve lever 139 contacts the plunger 133 of the throttle valve control mechanism 130 and is prevented from fully closing the throttle valve 54. Consequently, the second reference curve 171 begins to level out at a higher rpm corresponding with an rpm when the throttle valve 54 is maintained in a partially opened position. This increased rpm maintains an elevated thrust to allow the watercraft to be sharply turned after the operator has completely released the throttle lever 52. After a predetermined amount of time, such as, for example, 3 seconds, the throttle valve control mechanism 130 is disengaged at T2 and the throttle valve 54 is allowed to fully close to an idle position.

Thus, in one aspect, there is provided a throttle control mechanism 130 that maintains an engine rpm above an idle rpm for a predetermined amount of time (or until a certain control parameter occurs) following an abrupt release of the throttle lever 52.

The throttle valve control mechanism 130 can comprise a step motor or an electric motor employed in a feedback system. A servomotor also can be used in place of the step motor. Although a servomotor is usually larger than the step motor, the servomotor may be desirable in some applications because it eliminates the need for the throttle valve position sensor 90. Further, a solenoid may be used to provide the necessary linear displacement of the plunger 133.

Figure 7B:
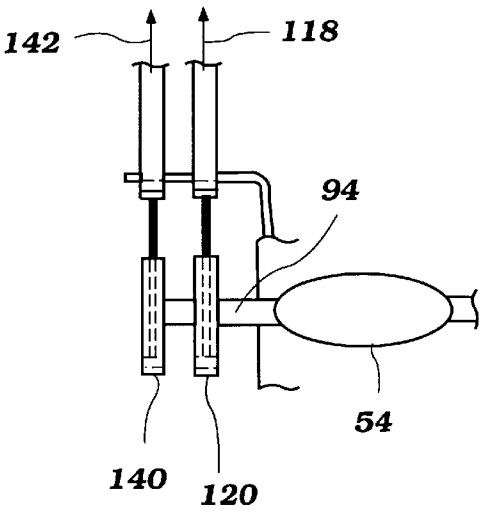
FIG. 7(B) is a schematic view of the pulley assembly used with this embodiment of the throttle valve control mechanism.
Figure 7A:
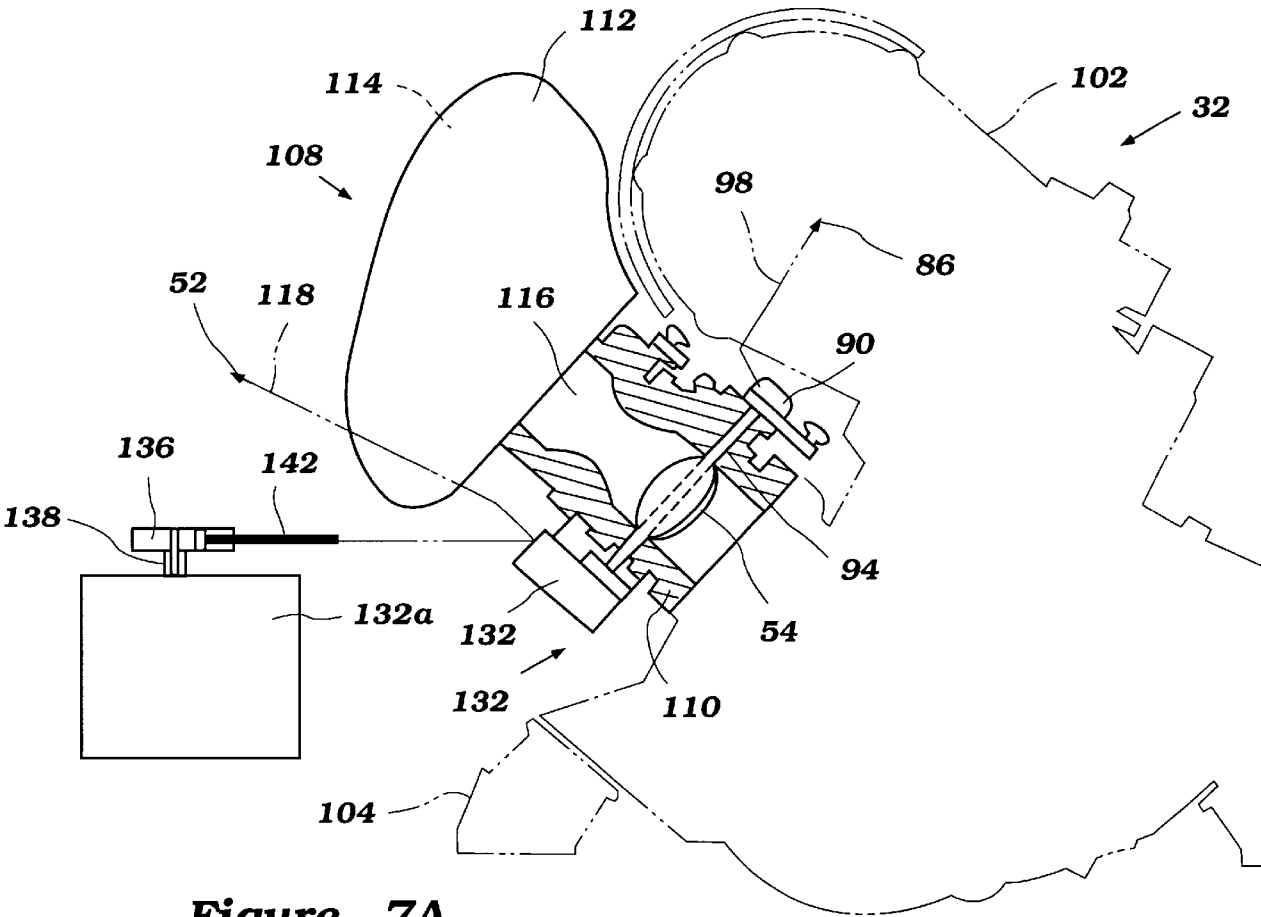
FIG. 7(A) is a schematic front view of the engine and illustrates another embodiment of the throttle valve control mechanism that employs a servomotor. A large part of the engine except for an air induction system and a throttle valve control mechanism is illustrated in phantom.

In the servomotor variation, as illustrated in FIGS. 7A and 7B, the servomotor 132*a* preferably is disposed apart from the engine body 102. The servomotor 132*a* has a pulley 136 on a shaft 138 that rotates about an axis (e.g., a vertical axis), while the throttle valve 54 has a corresponding pulley 140 on its shaft 94 next to the pulley 120 that is coupled to the throttle wire 118. A control wire 142 connects the pulleys 136, 140 with each other. The servomotor 132*a* moves the throttle shaft 94 in a controlled manner through this pulley system. The pulleys 140, 120, which are connected to the servomotor 132*a* and the throttle wire 118, respectively, can of course be positioned on different throttle shafts 94.

The throttle valve control mechanism 130 is connected to the ECU 86 by a control line. Normally, the operator operates the throttle valves 54 by the throttle lever 52. The ECU 86, however, overrides the control of the throttle lever 52 and causes the throttle valve control mechanism 130 to maintain (or to increase under other control strategies) the opening degree of the throttle valves 54 under certain operating conditions.

In the illustrated embodiment shown in FIGS. 1–5, five sensors or sensing mechanisms, i.e., the throttle valve position sensor 90, the steering position sensor 88, the throttle lever position sensor 89, the engine rpm sensor 91, and a watercraft velocity sensor 92, are employed for sensing the respective states or velocity of the watercraft and its engine. However, as described herein, only two sensors may be used to provide the appropriate engine control contemplated herein. In the illustrated embodiment, the throttle lever position sensor 89 and engine rpm sensor 91 may be all that is required to provide the ECU 86 enough feedback to appropriately control the engine output. But as noted above, other control parameters can be used in addition or in the alternative to engine speed and, thus, these other sensors can be used in place of the engine speed sensor in some applications of the present engine control system.

The throttle valve position sensor 89 preferably is a proximity sensor (e.g., a reed switch) to detect when the throttle lever is in a position corresponding to idle. Other sensors or sensing mechanisms such as a potentiometer can also be used.

The steering position sensor 88 preferably is a proximity sensor positioned adjacent to the steering mast 46 and senses an angular position of the steering mast 46. Other types of sensors or sensing mechanisms also can be used.

The velocity sensor 92 of the watercraft 30 preferably is a paddle-wheel type sensor positioned at a bottom portion or a submerged stern portion of the watercraft 30. Any other sensors acting as velocity sensors such as a dynamic pressure sensor disposed with the tunnel 66 or a Pitot tube type sensor disposed toward the body of water can replace the paddle-wheel type sensor 92. It would also be possible to use a GPS (global positioning system) that uses an artificial satellite and includes a GPS antenna comprises a velocity sensing mechanism. The sensing mechanism using the GPS is described in, for example, Japanese Laid Open Publication No. Hei 11-43093.

The ECU 86 has stored in its memory a reference watercraft engine rpm. In the illustrated embodiment, the reference rpm is selected from speeds greater than those that cause the watercraft 30 to start planing. In general, the jet type watercraft 30 transfers from a displacement (trolling) range to a transient range at a velocity of 10–15 Km/h (at an engine speed of 2,000–2,500 rpm) and then transfers to the planing range at a velocity of 30–35 Km/h (at an engine speed of 4,500 rpm). The watercraft 30 can stay in a complete planing range when the velocity is 35 Km/h or more (at the engine speed is 4,500 rpm or more). In the illustrated embodiment, the maximum speed of the engine 32 is about 7,000 rpm. Embodiments of the present invention, however, can be used with engines having greater or lesser top-end speeds. The velocity of the watercraft when it starts planing also depends upon the size and shape of its hull, the weight of the watercraft, the location of the watercraft's center of gravity, and the performance of the jet propulsion unit, to name a few additional factors. The reference engine speed can be determined empirically for a particular watercraft design and then stored in the ECU 86 of each watercraft made in accordance with such design. The predetermined reference engine speed of 4,000 rpm in this embodiment thus is merely an example.

As understood from the following embodiments, the ECU can also use other control parameters and, thus, store other reference parameters in its memory. For example, in accordance with one preferred embodiment, a reference throttle opening degree (Thθs) preferably is selected to correspond to a watercraft engine rpm that generates a thrust force sufficient to change sharply the direction of travel of the watercraft 30. The reference throttle opening degree (Thθs) increases with watercraft velocity. In the illustrated embodiment, where the throttle opening degree ranges from 0 to 90 degrees, the reference throttle opening degree (Thθs) preferably is not less than 30 degrees and increases with increasing watercraft speed. At throttle angles less than 30 degrees, the engine output may not be sufficient to produce enough thrust to turn the watercraft 30 sharply.

A reference steering position (Sds) also is preferably selected to correspond to a watercraft velocity. Unless the reference steering position (Sds) is large enough relative to the watercraft velocity, the watercraft 30 may not be as responsive as the rider would like at low speeds. The reference steering position (Sds) is variable and generally increases with increasing watercraft velocity. In the illustrated embodiment, the steering mast 46 rotates from a neutral position (for straight-ahead travel) by forty degrees (40°) to a fully turned position to each side. In other words, the steering mast 46 rotates from its neutral position (0°) by plus forty degrees (40°) when moved from the neutral position to a fully turned position to the right and by minus forty degrees (−40°) when moved from the neutral position to a fully turned position to the left. For such an embodiment, the reference steering position (Sds) preferably is not less than twenty degrees (20°) and varies relative to watercraft speed.

The ECU 86 may have stored in its memory at least one map that relates the reference throttle opening degrees (Thθs) to watercraft velocities (V) and at least another map that relates the reference steering positions (Sds) to the watercraft velocities (V). These maps are used for selecting the reference throttle opening degree (Thθs) and the steering positions (Sds) in response to a continually sensed watercraft velocity (V).

More thrust generally is required to turn the watercraft 30 sharply at higher speeds. The present control system 32 thus is adapted to maintain or increase the throttle angle to a desired throttle opening degree in order to enhance the responsiveness of the watercraft 30 and to ease watercraft operations during such turns. For this purpose, the ECU 86 has stored in its memory a map of objective throttle opening degrees (Thθm), i.e., desired throttle opening degrees, versus watercraft speed. In general, the throttle opening degree (Thθm) increases with increases in watercraft speed.

With reference to FIGS. 8(A)–(C), another embodiment of the throttle valve control mechanism 130B will be described below. The same reference numerals will be assigned to the same components and members that have been already described and further detailed description of such components and members will be omitted.

The engine in this embodiment also operates on a two cycle crankcase compression principle and has three cylinders. Three throttle bodies 110*a*, 110*b*, 110*c* are separately formed and coupled together by a lower linkage rail 210 and an upper linkage rail 212. That is, each throttle body 110*a*, 110*b*, 110*c* has a lower flange 214 that extends downward from the bottom thereof and defines a vertical face. Each throttle body 110*a*, 110*b*, 110*c* also includes an upper flange 216 that extends upward and defines a horizontal face. The respective lower flanges 214 are affixed to the vertical faces of the lower linkage rail 210 by screws 218, while the respective upper flanges 216 are affixed to the respective horizontal faces of the upper linkage rail 212 by screws 220. The linked throttle bodies 110*a*, 110*b*, 110*c* are affixed to the crankcase member of the engine body one side of the engine (e.g., the starboard side). One end 222 of each throttle body 110*a*, 110*b*, 110*c* communicates with the crankcase chamber through an appropriate intake manifold and the other end 224 communicates with the plenum chamber via an appropriate sleeve. The throttle valve shafts 94*a*, 94*b*, 94*c*, which support the throttle valves 54*a*, 54*b*, 54*c*, are journaled by bearing portions 228 of the throttle bodies 110*a*, 110*b*, 110*c* for pivotal movement. Coupling members 230 couple the throttle valve shafts 94*a*, 94*b*, 94*c* with one another so that all of the valve shafts 94*a*, 94*b*, 94*c* rotate together. Return springs are provided around the respective throttle valve shafts 94*a*, 94*b*, 94*c* in the bearing portions 228 to bias the shafts 94*a*, 94*b*, 94*c* toward a position in which the throttle valves 54*a*, 54*b*, 54*c* are closed. In other words, the throttle valves 54*a*, 54*b*, 54*c* are urged toward the closed position unless an actuation force acts on the valve shafts 94*a*, 94*b*, 94*c*.

The fuel injectors 232 are affixed to the throttle bodies 94*a*, 94*b*, 94*c* so that each nozzle portion of the injector 232 is directed to the intake passage 116*a*, 116*b*, 116*c* downstream of the throttle valve 54*b*. A fuel rail 234 is affixed to the throttle bodies 94*a*, 94*b*, 94*c* so as to support the fuel injectors 232 and also to form a fuel passage 236 therein through which the fuel sprayed by the injectors 232 is delivered.

In the illustrated embodiment, lubricant oil 238 is also injected toward the journaled portions of the valve shafts 94*a*, 94*b*, 94*c* in the intake passages 116*a*, 116*b*, 116*c* through oil injection nozzles 240. Lubricant injection at this point tends to inhibit salt water from depositing on the valve shafts and at the journaled portions of the valve shaft.

A motor flange 244 is unitarily formed with the most forward portion of the throttle body 110*c* and a valve control motor 246 is affixed thereto. The throttle valve shafts 94*a*, 94*b*, 94*c* in this arrangement are actuated only by this motor 246 in either a manual control mode by the rider or the engine output control mode by the ECU 86. No mechanical control wire or cable connects the throttle lever 52 and the valve shafts 94*a*, 94*b*, 94*c*. Instead, the throttle lever 52 is connected to a throttle lever position sensor that sends a signal to the ECU 86 through a signal line.

The engine output control mechanism 130B needs no throttle position sensor because the motor 246 has a built-in position sensor by which a signal indicating a position of the throttle shafts 94*a*, 94*b*, 94*c* is sent to the ECU 86. A watertight cover protects the motor 246. Because of the arrangements and constructions of the throttle bodies and valve control motor, the engine output control mechanism 130B is simple, accurate and durable.

With reference to FIGS. 9(A)–(C), a further embodiment of the throttle valve control mechanism 130C will be described below. The same reference numerals will also be assigned to the same components and members that have been already described and further detailed description of these components and members will be omitted.

In this arrangement, a pulley 250 is affixed to the middle throttle shaft 94*b* and a throttle wire 252 is affixed to the pulley 250. The throttle wire 252 also is connected to the throttle lever 52 so that the rider can manually operate the valve shafts 94*a*, 94*b*, 94*c* through the throttle wire 252. In the illustrated embodiment, the pulley 250 is disposed between the front throttle body and the middle throttle body. The pulley 250, however, can be disposed between the middle throttle body and the rear throttle body, and can be connected to any of the throttle shafts.

In the illustrated embodiment, the coupling 230 is positioned between the middle throttle body 110*b* and the rear throttle body 110*a* and has a lever portion 254 extending outward. The coupling 230 preferably lies on one side of the middle throttle body and the pulley 250 lies on the other side in order to simplify construction and provide a compact arrangement of these components.

A solenoid actuator 256 is disposed in a space between the middle throttle body 110*b* and the rear throttle body 110*a*. The solenoid actuator 256 depends from the upper linkage 212 and is affixed thereto. Also, a bracket 258, which is affixed to the rear throttle body 110*a*, extends forwardly from the rear throttle body to support a body of the actuator 256. The solenoid actuator 256 has a plunger 260 that extends toward the lever portion 254 of the coupling 230. The plunger 260 extends when a solenoid of the actuator 256 is activated to push or hold the lever portion 254 downward under control of the ECU 86.

The throttle position sensor 90 is affixed to a forward end of the throttle valve shaft 94*c* that is placed at the most forward position. The position sensor 90 senses the opening degree of the throttle valves 54*a*, 54*b*, 54*c* and send a signal to the ECU 86 as described above.

Normally, the rider manually operates the throttle shafts 94*a*, 94*b*, 94*c* through the wire 252 and the pulley 250. When the ECU 86 starts the engine output control mode, the plunger 260 pushes the lever portion 254. Under this condition, the throttle valve shafts 94*a*, 94*b*, 94*c* rotate to increase the throttle opening degree. The manual operation of the shafts 94*a*, 94*b*, 94*c* is regulated not to decrease the opening degree and is only allowed to increase further the opening degree. The plunger 260 also can be extended to prevent closing rotation of the throttle valves beyond the objective opening degree.

Because the solenoid actuator 256 is disposed between the throttle bodies 110*a*, 110*b* and hence is protected thereby, the engine output control mechanism 130C is durable and is protected, particularly against water.

Figure 11:
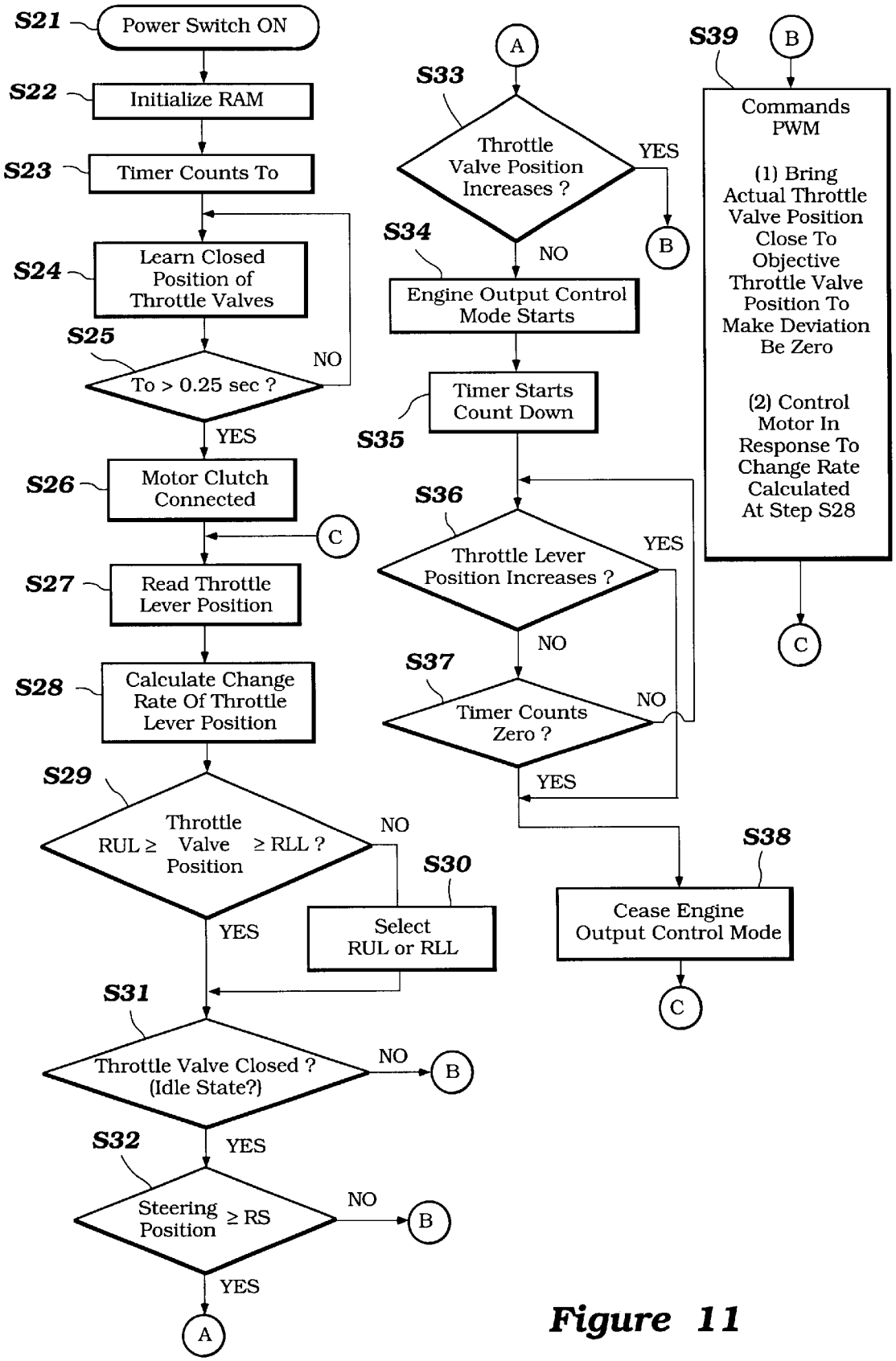
FIG. 11 is a control routine of an ECU of the control system shown in FIG. 10.

With reference to FIGS. 10 and 11, a further embodiment of the control system will now be described. The same reference numerals will again be assigned to the same components and members that have been already described and further detailed description of such components and members will be omitted.

FIG. 10 illustrates a further control system 34A. The steering mast 46 includes a steering shaft 380, the handlebar 48, a steering arm 382 and a tubular steering column 384. While the handlebar 48 is formed atop the steering shaft 380, the steering arm 382 is rigidly affixed to the bottom portion of the steering shaft 380. The steering column 384 is affixed to the upper hull section 40. The steering column 384 supports the steering shaft 380 for steering movement. With the rider steering with the handlebar 48, the steering arm 382 moves generally in a plane normal to the steering shaft 380. The steering arm 382 is connected to the deflector 76 through a deflector cable 386, and the deflector 76 pivots about the vertical axis 78 with the movement of the steering arm 382 in a known manner. A sensor arm 388 on which the steering position sensor 88 is disposed is rigidly affixed to the steering column 384. A lever 390 extends from the sensor 88 and a linkage member 392 couples the lever 390 with the steering arm 382. Because the lever 390 pivots with the movement of the steering arm 382, the steering position sensor 88 senses an angular position of the steering shaft 380. The sensed signal is set to the ECU 86 through a signal line 396.

The throttle lever 52 on the handlebar 48 is connected to a pulley 400 affixed to a shaft of a throttle lever position sensor 402 through a throttle wire 404. This throttle position sensor 402 is not affixed to the throttle valve shafts 94 but rather is separately provided for remotely sensing a position of the throttle lever 52. The sensed signal is sent to the ECU 86 through a signal line 406. Because the throttle valves 54 desirably are controlled by the throttle lever 52, the position of the throttle valves 54 should generally correspond to the position of this lever 52. A return spring 408 is provided at the throttle position sensor 402 so as to return the shaft of the position sensor 402 to an initial position unless the rider operates the throttle lever 52.

The control system 34A employs another engine output control mechanism 130E. This control mechanism 130E includes an electric motor 412 having a motor shaft 414. A first gear 416 is coupled with the motor shaft 414 via a clutch 418. Unless the clutch 418 is activated, the motor 412 does not rotate the first gear 416 and the first gear 416 merely idles. The first gear 414 meshes with a second gear 420 that in turn is coupled to a second shaft 422. Because a diameter of the second gear 420 is larger than a diameter of the first gear 414, a rotational speed of the second shaft 422 will be reduced relative to the rotational speed of the motor shaft 414.

A pulley 426 is affixed to the second shaft 422. The throttle bodies 110 (schematically illustrated in FIG. 10) also have a pulley 424 that actuates the throttle shafts. An actuator cable 426 connects together the pulleys 422, 424. A return spring 428 is affixed to one end of the second shaft 422 so as to return the first and second gears 416, 420 to their initial positions unless the clutch 418 is connected. A position sensor 430 is affixed to the other end of the reduction shaft 422 to sense an angular position of the shaft 422. The position sensor 430 sends a signal, which is indicative of the angular position of the shaft 422, to the ECU 86 through a signal line 432 for feedback control of the clutch 418 and/or the motor 412. The signal sensed by the position sensor 430 corresponds to the position of the throttle valves 54.

The position sensor 430 as well as the throttle lever position sensor 402 can be any type of angular position sensors such as a potentiometer type like the sensor 90 used in the preceding embodiments or a Hall IC type sensor.

The ECU 86 controls the motor 412 through a control line 434. A pulse width modulator or power amplifier 436 preferably is provided between the ECU 86 and the motor 412 to directly control the motor 412.

The ECU 86 also controls the clutch 418 through a control line 438. A switch 440, e.g., FET switch, preferably is provided between the ECU 86 and the clutch 418 to actuate the clutch 418. When a power switch, i.e., main switch, of the watercraft 30 is off, the ECU 86 is off and the switch 440 is disconnected. In the event of malfunction of the motor 412, the switch 440 is biased off and accordingly the clutch 418 is disconnected so that the throttle valves 54 can be manually operated.

The ECU 86 has a ROM to store at least a reference position of the steering shaft 380 and also has a RAM to store at least a current position signal of the throttle lever 52 and a change rate of the position signal. The ECU 86 also has a timer.

FIG. 11 illustrates a control routine of the control system 34A. The control routine starts at Step S21 when the rider turns on the main power switch. At Step S22, the ECU initializes stored data of the RAM and proceeds to Step S23. The timer starts to count time ($T_0$) at Step S23. At Step S24, the ECU 86 determines a closed position of the throttle valves 54 from the signal of the throttle valve position sensor 430. The ECU then determines whether the time ($T_0$) counted by the timer exceeds 0.25 seconds (Step S25). If 0.25 seconds has not elapsed, the ECU returns to Step S24 to repeat this step. If the time has elapsed, the ECU instructs the switch 440 to connect the clutch 418 (Step S26). Steps S21 through S26 comprise an initializing phase of the routine and are not repeated until engine is stopped and restarted.

At Step S27, the ECU 86 reads a current throttle lever position from the signal sensed by the throttle lever position sensor 402. The ECU then calculates the rate of change of the throttle lever position (Step S28). If the rate of change is zero, the rider wants to maintain the current throttle position. A large rate of change indicates quick movement of the throttle lever (e.g., when accelerating from rest) and a small rate of change indicates slow movement of the throttle lever (e.g., when docking the watercraft at which time the rider may more precisely control the throttle lever for slow speed maneuvering).

The ECU 86 then determines (at Step S29) whether the closed position of the throttle valves, which was read and stored into memory at Step S24, falls within a range defined between a reference upper limit (RUL) and a reference lower limit (RLL). If it does, the ECU proceeds to Step S31. If not, the ECU performs Step S30.

At the step S30, the ECU 86 selects either the reference upper limit (RUL) or the reference lower limit (RLL) as a hypothetical closed position. For example, the ECU may be programmed to determine which one of the RUL or RLL is closer to measured value, and then use the closest one as the hypothetical closed position. The ECU then proceeds to the Step 31.

At Step S31, the ECU 86 determines whether the engine 32 is in an idle state, i.e., whether the throttle valves 54 are closed. This determination uses either the actual closed position sensed by the throttle valve position sensor 430 or the hypothetical closed position replaced at the step S30, depending upon the conclusion reached at Step S29. The idle engine speed of the engine 32 is, for example, 1,200 rpm. If the engine is operating above idle, the ECU proceeds to Step S39 to instruct the pulse width modulator 436 to practice a normal control mode for controlling the throttle drive motor 412. If, however, the engine is at idle, the ECU proceeds to Step S32.

The pulse width modulator 436 practices the following two controls at the step S39. The first control (i.e., Control (1)) involves bringing the actual throttle opening degree sensed by the throttle valve position sensor 430 close to the desired throttle opening sensed by the throttle lever position sensor 402. For this purpose, any deviation between these two sensed values preferably is minimized to the extent possible by actuating the motor 412 to move the throttle valves.

The second control (i.e., Control (2)) involves controlling the motor 412 through the pulse width modulator 436 in response to the change rate calculated at Step S28. If the rate of change is large, the modulator 436 supplies the motor 412 with a relatively high power level so that the motor 412 rotates at a relatively high speed. If the rate of change is small, then the modulator 436 supplies the motor 412 with a relatively low power level so that the motor 412 rotates at a relatively low speed. After performing Step S39, the program returns to Step S27.

If the ECU determines that the throttle valves are closed (Step S31), the ECU 86 then determines at Step S32 whether the steering position sensed by the steering position sensor 88 is greater than a reference steering position (RS). If no, the ECU does not begin its engine output control mode and proceeds to control the modulator 436 in its normal manner (Step S39). If, however, the sensed steering position is greater than the reference steering position (RS), i.e., the rider has turned the steering bar 48 by more than a predetermined degree, the ECU proceeds to Step S33 for a further calculation before deciding whether to begin its engine output control mode.

The ECU 86 at Step S33 determines whether the throttle valve opening, and consequently the engine output, is increasing. The assessment of this situation can be determined from whether the actual throttle opening degree is increasing from the closed position under the rider's own control. If yes, the program proceeds to Step S39. If not, the ECU begins its engine output control mode (Step S34). This step S33 is advantageous if a manual control or an independent control of the throttle valves is employed. This step S33, however, can be omitted in the illustrated control system 34A.

At Step S34, the ECU 86 instructs the pulse width modulator 436 to drive the motor 412 in a direction that increases the throttle valve opening degree. Under this control, the throttle valves are opened to a predetermined throttle opening that corresponds with a desired engine speed. In one embodiment, the engine speed preferably is increased to within the range of about 1,500 to about 4,000 rpm, and more preferably to within the range of about 2,500 to 3,500 rpm, and in one embodiment, to 3,000 rpm. The desired engine speed preferably is sufficient to effect sharp turning of the watercraft. The ECU 86 then starts the timer (Step S35) to count off a predetermined amount of time (i.e., starts a count down).

At Step S36, the ECU 86 determines whether the throttle lever position is greater than the idle position. If yes, the rider is operating the throttle lever 52 to increase the engine output and the program proceeds to Step S38 to stop the engine output control mode. If no, the ECU proceeds to Step S37.

At Step S37, the ECU determines whether the timer has finished the count down. The time period of this count down is preferably within the range of from about 1 second to 5 seconds, and in one embodiment, is about 3 seconds. If this time has not elapsed, the ECU repeats Step S36. If the time has expired, the ECU ceases the engine output control mode (Step S38), and returns to the main control routine at Step S27.

Although this engine control system has been described in terms of certain preferred embodiments, other embodiments and variations of the foregoing examples will be readily apparent to those of ordinary skill in the art. For example, the output of the throttle valve position sensor in the described embodiments can be directly or indirectly used as a control parameter of the ECU. That is, for example, a sensed throttle opening degree, an absolute value of the sensed opening degree, an increase or decrease amount of the opening degree and a rate of change of the opening degree can all be used as the control parameter(s).

Additionally, the output of the steering position sensor can be directly or indirectly used as another control parameter of the ECU. That is, for example, a sensed angular position, an absolute value of the sensed angular position, an increase or decrease amount of the angular position and a rate of change of the angular position are all applicable as the control parameter(s).

The output of the velocity sensor can be directly or indirectly used as a further control parameter of the ECU. That is, for example, a sensed velocity, an absolute value of the velocity, an increase or decrease amount of the velocity and a change rate of the velocity are all applicable as the control parameter.

The sensors can be positioned not only in close proximity to thing that they are measuring but also at a remote place. If the sensors are remotely disposed, an appropriate mechanical, electrical or optical linkage mechanism can be applied.

Conventional sensors are all applicable as the sensor described above whether they are given as examples or not. Additionally, conventional actuators using, for example, electrical power or fluid power (e.g., air pressure, water pressure or hydraulic oil pressure) are all applicable as the actuator for the engine output control whether they are exemplified or not.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combination or sub-combinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A jet propelled watercraft comprising:

an engine having at least one throttle valve, the throttle valve being movable between an idle position and a fully open position;

a throttle operator remotely positioned relative to the engine and coupled to the throttle valve, the throttle operator being movable between first and second positions whereby the throttle operator causes the throttle valve to move between the idle and fully open positions, respectively; and an engine control system comprising a first sensor configured to detect an operating state of the watercraft or the engine, a second sensor configured to detect a position of the throttle operator, a throttle valve control mechanism including an actuator cooperating with the throttle valve under at least one operating state of the watercraft or the engine, and a controller communicating with the first and second sensors and with the throttle valve control mechanism, the controller being configured to activate the throttle valve control mechanism once the operating state of the watercraft or engine is greater than a predetermined state for a preset period of time and to leave active the throttle valve control mechanism at least when the throttle operator quickly moves to the first position so as to maintain the throttle valve between the idle and fully open positions.

2. The watercraft of claim 1, wherein the throttle operator is coupled to the throttle valve by a throttle drive mechanism, and the actuator is coupled to the throttle valve independently of the throttle drive mechanism.

3. The watercraft of claim 2, wherein the throttle drive mechanism comprises a throttle pulley.

4. The watercraft of claim 3, wherein the throttle drive mechanism additionally comprises a cable linking the throttle operator to the throttle pulley and a biasing member arranged to bias the throttle operator towards the first position.

5. The watercraft of claim 1, wherein the first sensor is an engine speed sensor configured to output a signal to the controller that is indicative of engine rotational speed.

6. The watercraft of claim 1, wherein the first sensor is a watercraft speed sensor configured to output a signal to the controller that is indicative of a vehicle speed of the watercraft.

7. The watercrafi of claim 1, wherein the first sensor is a throttle valve position sensor configured to output a signal to the controller that is indicative of the position of the throttle valve.

8. The watercraft of claim 1, wherein throttle valve control mechanism is configured to maintain the throttle valve open to a degree corresponding to a trolling condition of the watercraft.

9. The watercraft of claim 1, wherein throttle valve control mechanism is configured to maintain the throttle valve open to a degree corresponding to a transient condition of the watercraft between a displacement mode of operation and a planing mode of operation.

10. The watercraft of claim 1, wherein the engine control system additionally comprises a steering angle sensor, and wherein the controller is configured to deactivate the throttle valve control mechanism so as to permit the throttle valve to return to an idle position when a steering angle is less than a preset degree.

11. The watercraft of claim 1, wherein the controller and the throttle valve control mechanism are configured to maintain the throttle valve at a preset position between the idle and fully open positions.

12. The watercraft of claim 1, wherein the controller and the throttle valve control mechanism are configured to retard movement of the throttle valve from a preset position, which lies between the idle and fully open positions, to the idle position.

13. The watercraft of claim 12, wherein the controller and the throttle valve control mechanism are configured to gradually decrease the opening degree of the throttle valve at least over a range of movement between the preset position and the idle position.

14. A jet propelled watercraft comprising:

an engine having at least one throttle valve, the throttle valve being movable between a closed position and a fully open position;

a throttle operator remotely positioned relative to the engine and coupled to the throttle valve, the throttle operator being movable between first and second positions whereby the throttle operator causes the throttle valve to move between the closed and fully open positions, respectively;

a steering mast comprising a handlebar rotatably carried by the steering mast and configured to steer the watercraft; and an engine control system comprising a first sensor configured to detect an operating state of the watercraft or the engine, a second sensor configured to detect a position of the throttle operator, a third sensor configured to detect an angular orientation of the handlebar, a throttle valve control mechanism including an actuator cooperating with the throttle valve under at least one operating state of the watercraft or the engine, and a controller communicating with the first and second sensors and with the throttle valve control mechanism, the controller being configured to activate the throttle valve control mechanism once the operating state of the watercraft or engine is greater than a predetermined state, and the controller and throttle valve control mechanism further being configured to delay closure of the throttle valve at least when the throttle operator moves to the first position and the handlebar exceeds a predetermined angular orientation, wherein the first sensor is an engine speed sensor configured to output a signal to the controller that is indicative of engine rotational speed.

15. A jet propelled watercraft comprising:

an engine having at least one throttle valve, the throttle valve being movable between a closed position and a fully open position;

a throttle operator remotely positioned relative to the engine and coupled to the throttle valve, the throttle operator being movable between first and second positions whereby the throttle operator causes the throttle valve to move between the closed and fully open positions, respectively;

a steering mast comprising a handlebar rotatably carried by the steering mast and configured to steer the watercraft; and an engine control system comprising a first sensor configured to detect an operating state of the watercraft or the engine, a second sensor configured to detect a position of the throttle operator, a third sensor configured to detect an angular orientation of the handlebar, a throttle valve control mechanism including an actuator cooperating with the throttle valve under at least one operating state of the watercraft or the engine, and a controller communicating with the first and second sensors and with the throttle valve control mechanism, the controller being configured to activate the throttle valve control mechanism once the operating state of the watercraft or engine is greater than a predetermined state, and the controller and throttle valve control mechanism further being configured to delay closure of the throttle valve at least when the throttle operator moves to the first position and the handlebar exceeds a predetermined angular orientation, wherein the controller is configured to activate the throttle valve control mechanism once the operating state of the watercraft or engine is greater than a predetermined state for a preset period of time.

16. The watercraft according to claim 1, wherein the controller is configured to prevent actuation of the throttle valve control mechanism until the operating state of the watercraft or engine is greater than a predetermined state for the preset period of time.

* * * * *